US009136603B2

(12) United States Patent
Sim et al.

(10) Patent No.: US 9,136,603 B2
(45) Date of Patent: Sep. 15, 2015

(54) MULTI-BAND DIPOLE ANTENNA ASSEMBLIES FOR USE WITH WIRELESS APPLICATION DEVICES

(75) Inventors: Ee Wei Sim, Penang (MY); Kok Jiunn Ng, Perak (MY)

(73) Assignee: Laird Technologies, Inc., Earth City, MO (US)

( * ) Notice: Subject to any disclaimer, the term of this patent is extended or adjusted under 35 U.S.C. 154(b) by 784 days.

(21) Appl. No.: 12/984,858

(22) Filed: Jan. 5, 2011

(65) Prior Publication Data

US 2011/0095954 A1 Apr. 28, 2011

Related U.S. Application Data

(63) Continuation-in-part of application No. PCT/MY2008/000072, filed on Jul. 17, 2008.

(30) Foreign Application Priority Data

Jul. 14, 2008 (MY) ..... PI20082607

(51) Int. Cl.

| | |
|---|---|
| ***H01Q 13/10*** | (2006.01) |
| ***H01Q 9/28*** | (2006.01) |
| ***H01Q 1/08*** | (2006.01) |
| ***H01Q 13/12*** | (2006.01) |
| ***H01Q 5/364*** | (2015.01) |

(52) U.S. Cl.

CPC ..... *H01Q 9/28* (2013.01); *H01Q 1/084* (2013.01); *H01Q 5/364* (2015.01); *H01Q 13/12* (2013.01)

(58) Field of Classification Search

USPC ..... 343/767, 895, 900, 700 MS, 702, 846, 343/795, 790

See application file for complete search history.

(56) References Cited

U.S. PATENT DOCUMENTS

| | | | | | |
|---|---|---|---|---|---|
| RE29,296 | E | * | 7/1977 | Krutsinger et al. | 343/700 MS |
| 4,217,589 | A | * | 8/1980 | Stahler | 343/722 |
| 4,730,195 | A | * | 3/1988 | Phillips et al. | 343/792 |
| 5,231,412 | A | * | 7/1993 | Eberhardt et al. | 343/790 |
| 5,563,615 | A | * | 10/1996 | Tay et al. | 343/749 |
| 5,617,105 | A | * | 4/1997 | Tsunekawa et al. | 343/702 |
| 5,872,546 | A | * | 2/1999 | Ihara et al. | 343/795 |

(Continued)

FOREIGN PATENT DOCUMENTS

| | | |
|---|---|---|
| CN | 1937313 | 3/2007 |
| TW | M542423 | 7/2003 |

(Continued)

OTHER PUBLICATIONS

The ARRL Antenna Book, The American Radio Relay League, Eq. 1.*

International Search Report and Written Opinion from PCT application No. PCT/MY2008/000072 (now published as WO 2010/008269) which is related to the instant application through a priority claim; Mar. 12, 2009; 13 pages.

(Continued)

*Primary Examiner* — Sue A Purvis
*Assistant Examiner* — Jae Kim
(74) *Attorney, Agent, or Firm* — Harness, Dickey & Pierce, P.L.C.

(57) ABSTRACT

According to various aspects, antenna elements are provided for multi-band sleeve dipole antenna assemblies for use with wireless application devices. The antenna elements generally include first and second radiating elements. The first radiating elements may be tuned for receiving electrical resonant frequencies within a first frequency bandwidth. The second radiating elements may be tuned for receiving electrical resonant frequencies within a second frequency bandwidth different from the first frequency bandwidth.

22 Claims, 19 Drawing Sheets

(56) References Cited

U.S. PATENT DOCUMENTS

| | | | | |
|---|---|---|---|---|
| 6,380,900 | B1 * | 4/2002 | Kanayama | 343/702 |
| 6,842,155 | B1 * | 1/2005 | Yeh | 343/790 |
| 6,870,508 | B1 * | 3/2005 | Rivera | 343/709 |
| 6,999,034 | B1 | 2/2006 | Tsai et al. | |
| 7,365,698 | B2 * | 4/2008 | Dwyer et al. | 343/792 |
| 2004/0125030 | A1 | 7/2004 | Sung et al. | |
| 2005/0001767 | A1 | 1/2005 | Wulff et al. | |
| 2005/0134516 | A1 | 6/2005 | Du | |
| 2006/0019727 | A1 * | 1/2006 | Kang | 455/575.1 |
| 2006/0250319 | A1 * | 11/2006 | Ooi et al. | 343/895 |
| 2007/0109200 | A1 | 5/2007 | Su | |
| 2009/0284432 | A1 * | 11/2009 | Cozzolino et al. | 343/821 |

FOREIGN PATENT DOCUMENTS

| | | |
|---|---|---|
| TW | M253071 | 12/2004 |
| TW | M266563 | 6/2005 |
| TW | I264145 | 10/2006 |
| WO | WO 01/06594 | 1/2001 |
| WO | WO 2010/008269 | 1/2010 |

OTHER PUBLICATIONS

Taiwan Office Action dated May 8, 2013 from related co-pending Taiwan application No. 098116697 filed May 20, 2009 which claims priority to the same parent application (Malaysian application No. PI 20082607 filed Jul. 14, 2008) as the instant application; 20 pages.

Substantive Examination Adverse Report (dated May 13, 2011) from Malaysian application No. PI 20082607. The instant application is a continuation-in-part of PCT/MY2008/000072 (now published as WO 2010/008269), which claims priority to Malaysian application No. PI20082607; 4 pages.

Second Chinese office action for Chinese application No. 200880130358.9 (published as CN102099960) dated Nov. 28, 2013; 7 pages. The instant application and Chinese patent application No. 2008801030589 both claim priority to PCT application No. PCT/MY2008/000072 (published as WO 2010/008269).

Notice of Allowance dated Nov. 22, 2013 and its English translation for Taiwanese application No. 08116697 (published as 201004041) which claims priority to the same parent application (Malaysian application No. PI 20082607 filed Jul. 14, 2008) as the instant application); 3 pages.

* cited by examiner

MULTI-BAND DIPOLE ANTENNA ASSEMBLIES FOR USE WITH WIRELESS APPLICATION DEVICES

CROSS-REFERENCE TO RELATED APPLICATIONS

This application is a continuation-in-part of International Patent Application No. PCT/MY2008/000072 (now published as WO 2010/008269), filed Jul. 17, 2008, which claims priority to Malaysian patent application number PI 20082607, filed Jul. 14, 2008. The entire disclosures of each of the above applications are incorporated herein by reference.

FIELD

The present disclosure generally relates to multi-band dipole antenna assemblies for use with wireless application devices.

BACKGROUND

The statements in this section merely provide background information related to the present disclosure and may not constitute prior art.

Wireless application devices, such as laptop computers, are commonly used in wireless operations. And such use is continuously increasing. Consequently, additional frequency bands are required to accommodate the increased use, and antenna assemblies capable of handling the additional different frequency bands are desired.

FIG. 1 illustrates a conventional multi-band antenna assembly 1. The illustrated antenna assembly 1 generally includes a chassis 3, a sleeve 5, and a solid, non-tubular cylindrical radiating element 7. The antenna element 7 has different diameters and includes first and second cylindrical radiating elements 9, 11, which have aligned centerline longitudinal axes. The first radiating element 9 is positioned adjacent the sleeve 5 and is held to the sleeve 5 by a heat shrink wrap 13. The first radiating element 9 also includes a larger diameter than the second radiating element 11. A coaxial cable 15 extends through the chassis 3, couples to the sleeve 5 at a forward location of the chassis 3, and then couples to the first radiating element 9 for use in operation of the antenna assembly 1.

SUMMARY

This section provides a general summary of the disclosure, and is not a comprehensive disclosure of its full scope or all of its features.

According to various aspects, exemplary embodiments are provided of antenna elements for multi-band antenna assemblies for use with wireless application devices. One exemplary embodiment provides an antenna element for a multi-band sleeve dipole antenna assembly that is configured to be installed to a wireless application device. The antenna element generally includes a first radiating element tuned for receiving electrical resonant frequencies within a first frequency bandwidth, and a second radiating element tuned for receiving electrical resonant frequencies within a second frequency bandwidth different from the first frequency bandwidth. At least part of the first radiating element and/or at least part of the second radiating element have a non-planar construction defining a non-solid (e.g., generally hallow, etc.) interior portion. Whereby the first and second radiating elements are configured for use with a multi-band sleeve dipole antenna assembly.

Another exemplary embodiment provides a dipole antenna assembly configured to be installed to a wireless application device. The dipole antenna assembly generally includes a coaxial cable, a sleeve coupled to the coaxial cable, and an antenna element coupled to the coaxial cable adjacent the sleeve. The sleeve is operable as a ground for the dipole antenna assembly. And, the antenna element includes a first radiating element and a second radiating element. The first radiating element is tuned for receiving electrical resonant frequencies within a first frequency bandwidth and the second radiating element is tuned for receiving electrical resonant frequencies within a second frequency bandwidth different from the first frequency bandwidth.

Another exemplary embodiment provides a method of making an antenna element for a multi-band sleeve dipole antenna assembly that is configured for installation to a wireless application device. The method generally includes forming a body of an antenna element from a sheet of conductive material such that the body includes a first radiating element and a second radiating element, and forming the body of the antenna element such that at least part of the body includes a generally tubular shape.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure in any way.

Figure 28:
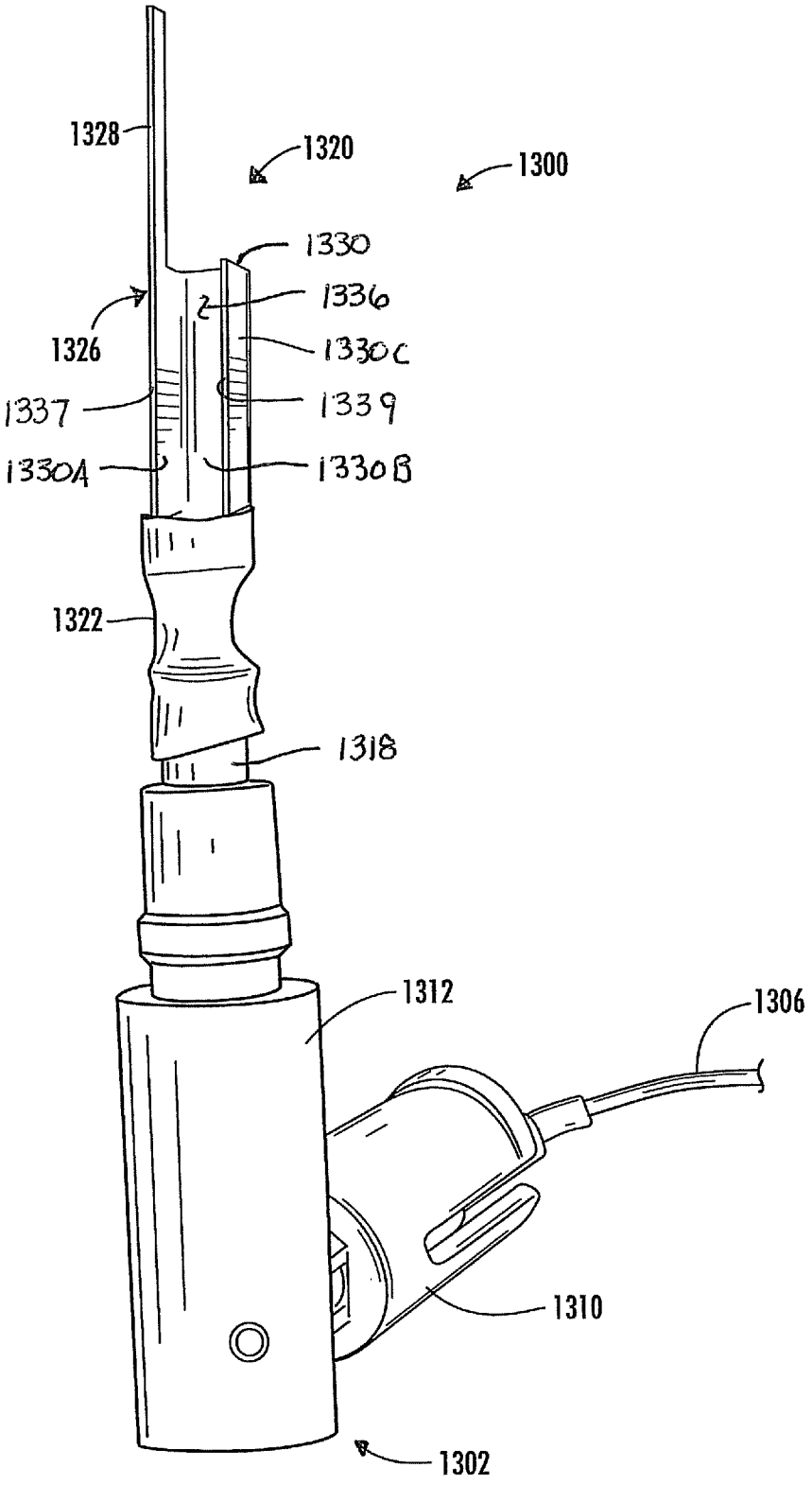
FIG. 28 is a forward perspective view of an exemplary antenna assembly with a cover of the antenna assembly removed to show internal construction, including a sleeve, an antenna element, and a wrap thereof with the wrap shown coupling the antenna element to the sleeve.
Figure 32:
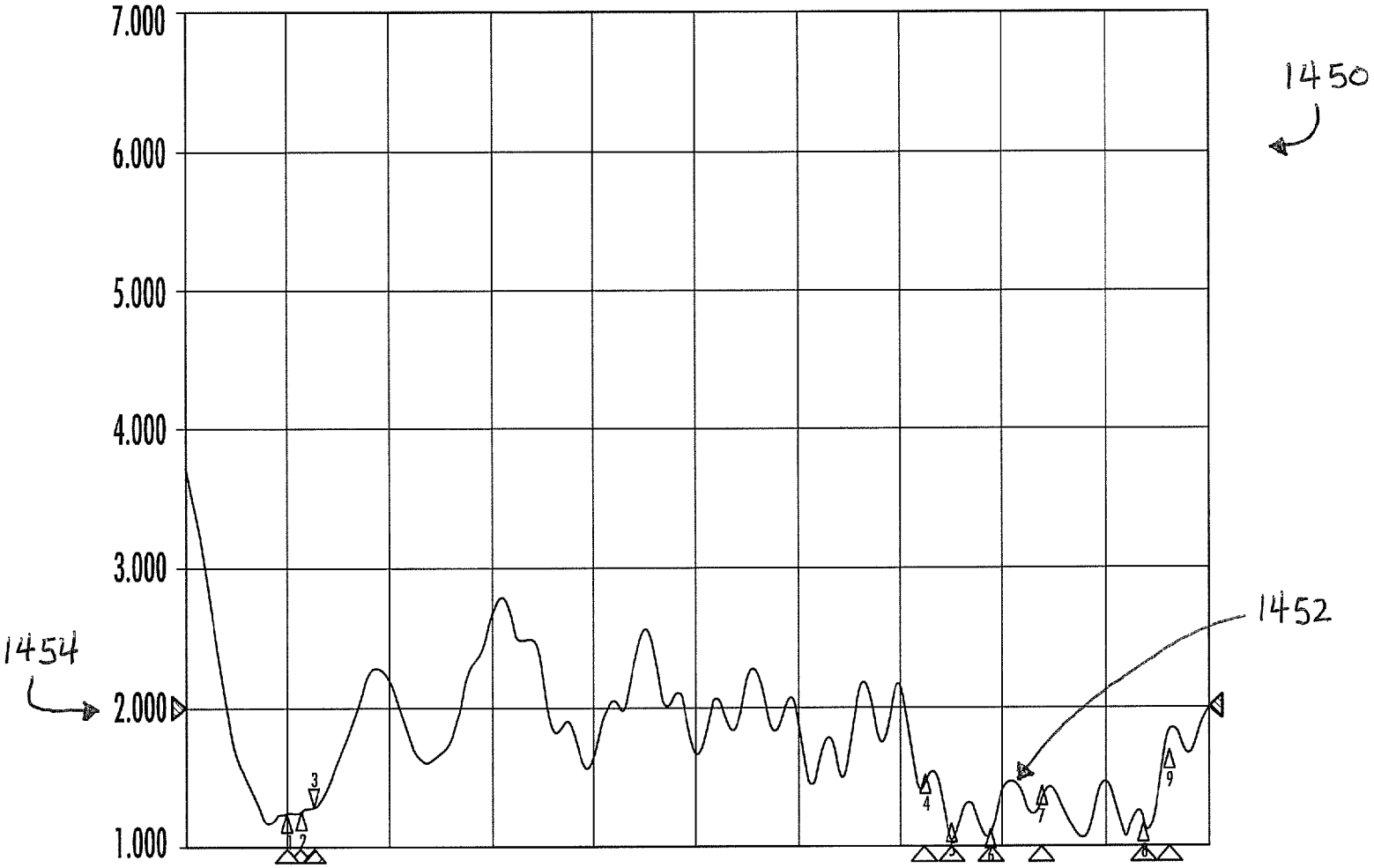

FIG. 31 is a line graph illustrating voltage standing wave ratios (VSWRs) for the exemplary antenna assembly shown in FIG. 28 over a frequency bandwidth of about 2000 MHz to about 6000 MHz, with an intermediate frequency bandwidth (IFBW) of about 70 kHz, and without inclusion of a ferrite bead (also, a ferrite core, etc.) along a cable of the antenna assembly; and FIG. 32 is a line graph illustrating voltage standing wave ratios (VSWRs) for the exemplary antenna assembly shown in FIG. 28 over a frequency bandwidth of about 2000 MHz to about 6000 MHz, with an intermediate frequency bandwidth (IFBW) of about 70 kHz, and with inclusion of a ferrite bead (also, a ferrite core, etc.) along a cable of the antenna assembly.

Corresponding reference numerals indicate corresponding parts throughout the several views of the drawings.

DETAILED DESCRIPTION

According to various aspects of the present disclosure, antenna assemblies (e.g., multi-band antenna assemblies, etc.) are provided suitable for operation over different bands of wavelengths. For example, the antenna assemblies may be suitable for operation over a bandwidth ranging between about 2400 MHz and about 2500 MHz, and over a bandwidth ranging between about 4900 MHz and about 5850 MHz. Antenna assemblies may be tuned to suit for operation over bandwidths having different frequency ranges within the scope of the present disclosure. In addition, the antenna assemblies may be used, for example, in systems and/or networks such as those associated with wireless internet service provider (WISP) networks, broadband wireless access (BWA) systems, wireless local area networks (WLANs), cellular systems, etc. The antenna assemblies may receive and/or transmit signals from and/or to the systems and/or networks within the scope of the present disclosure.

With reference now to the drawings, FIGS. 2 through 10 illustrate an exemplary multi-band sleeve antenna assembly 100 embodying one or more aspects of the present disclosure. The illustrated antenna assembly 100 may be installed to a wireless application device (not shown), including, for example, personal computers, portable computers, wireless routers, wireless alarm systems, wireless playstations, wireless portable gaming systems (e.g., SONY playstation), wireless soundstations, etc. within the scope of the present disclosure. In particular, the illustrated antenna assembly 100 may be installed to a wireless application device such that at least part of the antenna assembly 100 is located externally of the device and is visible from outside the device.

Figure 1:
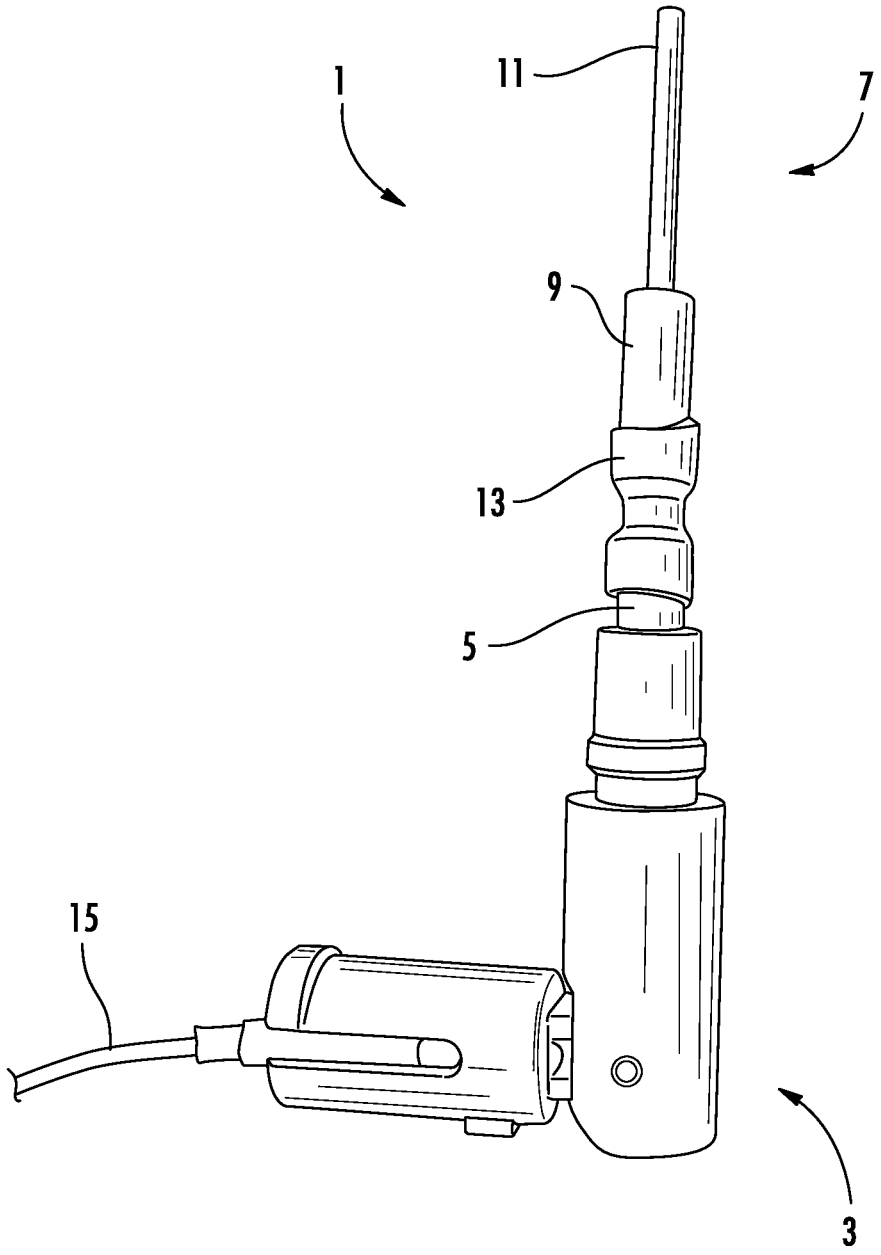
FIG. 1 (PRIOR ART)
FIG. 1 is a perspective view of a prior art antenna assembly.
Figures 2, 3, 4:
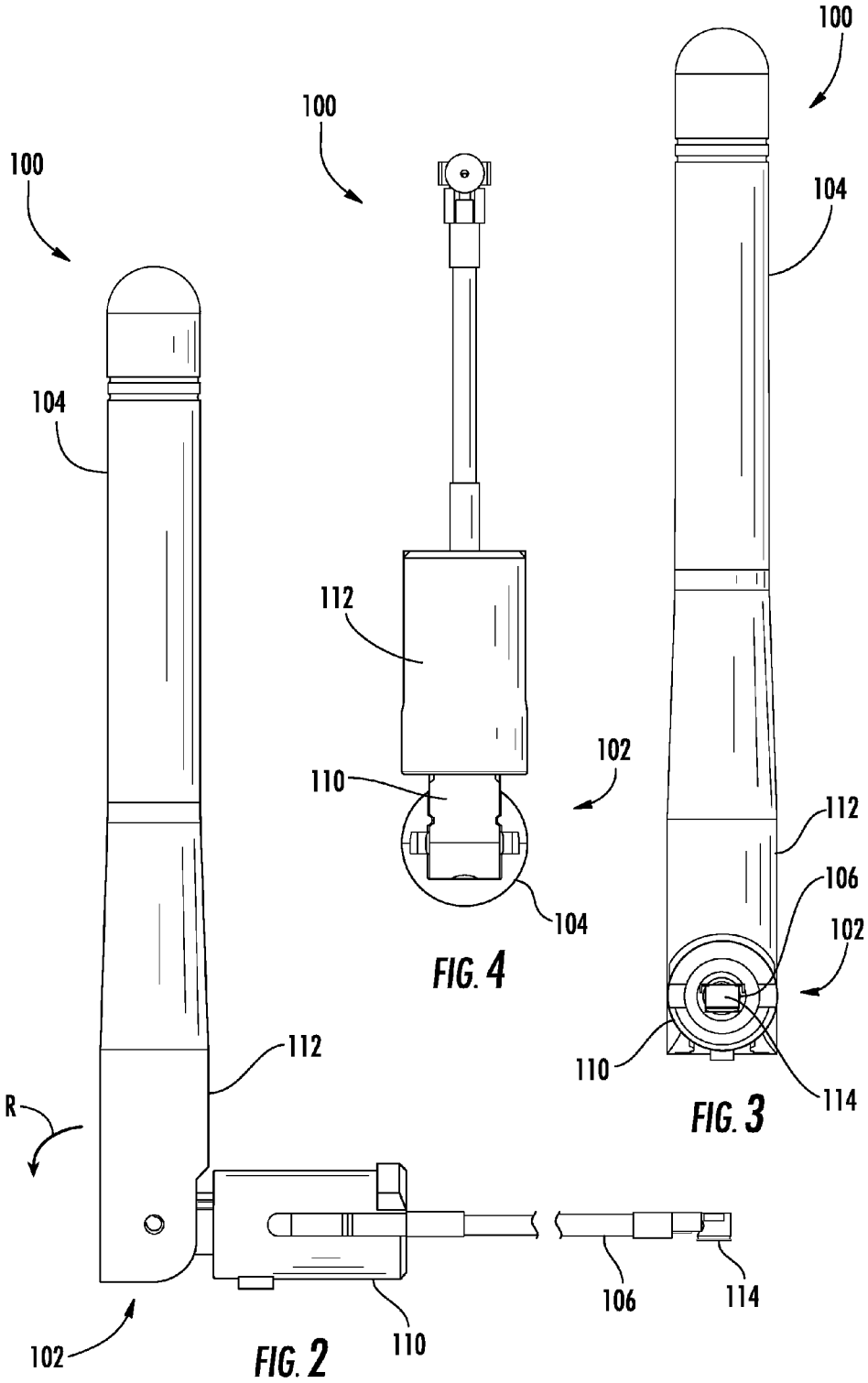
FIG. 2 is a side elevation view of an antenna assembly according to an exemplary embodiment of the present disclosure.
FIG. 3 is a rear elevation view of the antenna assembly of FIG. 2.
FIG. 4 is a bottom plan view of the antenna assembly of FIG. 2.
Figure 5:
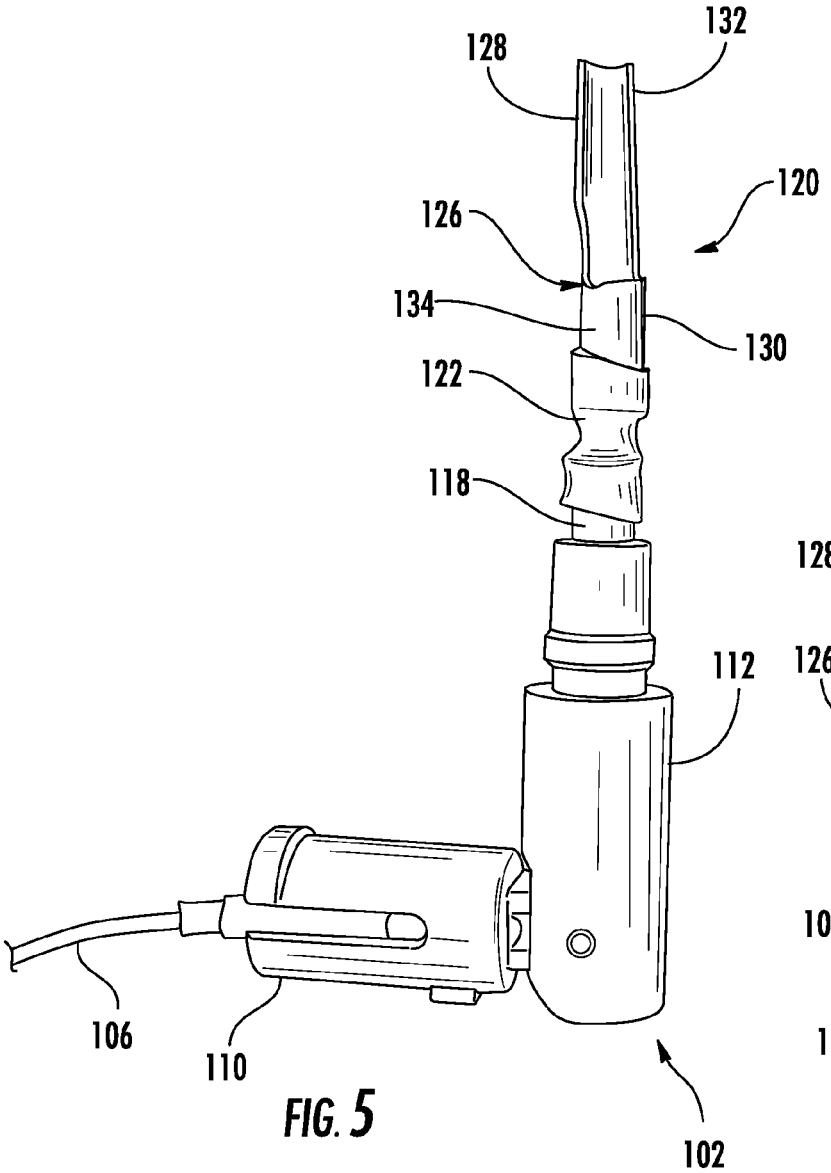
FIG. 5 is a perspective view of the antenna assembly of FIG. 2 with a cover of the antenna assembly removed to show internal construction of the antenna assembly, including a sleeve, an antenna element, and a wrap thereof with the wrap shown coupling the antenna element to the sleeve.
Figure 6:
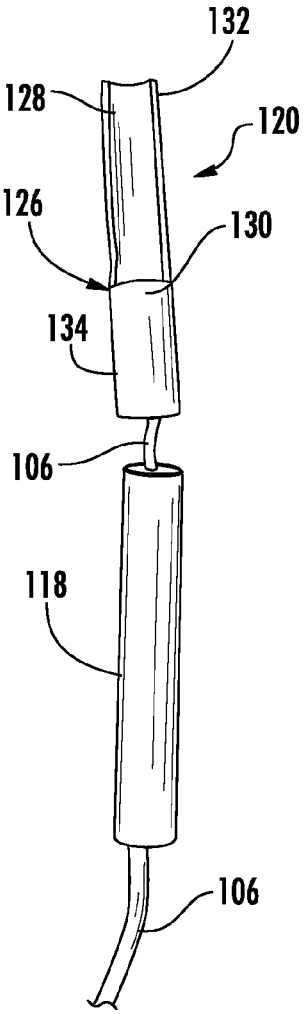
FIG. 6 is an enlarged, fragmentary perspective view of the internal construction of the antenna assembly of FIG. 5 with the wrap of the antenna assembly removed, showing a coaxial cable coupled to the sleeve and antenna element of the antenna assembly.

As shown in FIGS. 2 through 4, the illustrated antenna assembly 100 generally includes a chassis 102 (broadly, a support member), a cover 104 (or sheath, etc.) removably mounted to the chassis 102, and a coaxial cable 106 extending through the chassis 102 and into the cover 104. The cover 104 extends generally upwardly of the chassis 102 such that the illustrated antenna assembly 100 may include, for example, an overall height dimension of about 88.0 millimeters.

The chassis 102 of the illustrated antenna assembly 100 includes a mount 110 and a base 112. The mount 110 is configured (e.g., sized, shaped, constructed, etc.) to couple the antenna assembly 100 to a wireless application device. The base 112 is configured to support the cover 104 (and the components located within the cover 104, which will be described in more detail hereinafter) above the base 112. The base 112 is pivotally coupled to the mount 110, allowing the base 112 and cover 104 (and components located within the cover 104) to rotate relative to the mount 110 as indicated by arrow R (FIG. 2) during operation (e.g., to improve wireless signal reception, etc.). For example, the mount 110 may couple the antenna assembly 100 to a wireless application device such that the base 112 and cover 104 are located externally of the wireless application device. The base 112 and cover 104 can thus be rotated as desired (from outside the wireless application device) relative to the mount 110 and the wireless application device.

The cover 104 of the illustrated antenna assembly 100 may help protect the components of the antenna assembly 100 enclosed within the cover 104 against mechanical damage. The cover 104 may also provide an aesthetically pleasing appearance to the antenna assembly 100. Covers may be configured (e.g., shaped, sized, constructed, etc.) differently than disclosed herein within the scope of the present disclosure.

The coaxial cable 106 electrically couples the antenna assembly 100 (e.g., the components located within the cover 104, etc.) to a wireless application device to which the antenna assembly 100 is mounted (e.g., to a printed circuit board within the wireless application device, etc.). For example, the coaxial cable 106 may be used for transmission medium between the antenna assembly 100 and the wireless application device. A connector 114 (e.g., an I-PEX connector, a SMA connector, a MMCX connector, etc.) is provided toward an end of the coaxial cable 106 for electrically coupling the coaxial cable 106 (and antenna assembly 100) to the wireless application device.

Referring now to FIGS. 5 through 7 and 26, the illustrated antenna assembly 100 also generally includes a metallic sleeve 118, an antenna element 120 located generally upwardly of the sleeve 118, and a wrap 122 (FIG. 5) coupling the antenna element 120 to the sleeve 118. The coaxial cable 106 extends through the chassis 102 where an outer portion 107 (FIG. 26) (e.g., a metallic braid, etc.) of the cable 106 couples to the sleeve 118. By way of example, the outer portion 107 (e.g., metallic braid, etc.) of the cable 106 may be coupled to the sleeve 118 by way of soldering or a crimping process. The sleeve 118 acts as a ground of the antenna with the length thereof being about a quarter wavelength of the low operating frequency band. As such, the sleeve 118 contributes to the frequency characteristics described herein of the antenna element 120. Thus, the illustrated dipole antenna assembly 100 includes therein a ground in the form of sleeve 118. As a point of distinction, multi-band monopole antenna assemblies are typically dependent on a ground of a device in which they are installed.

Figure 26:
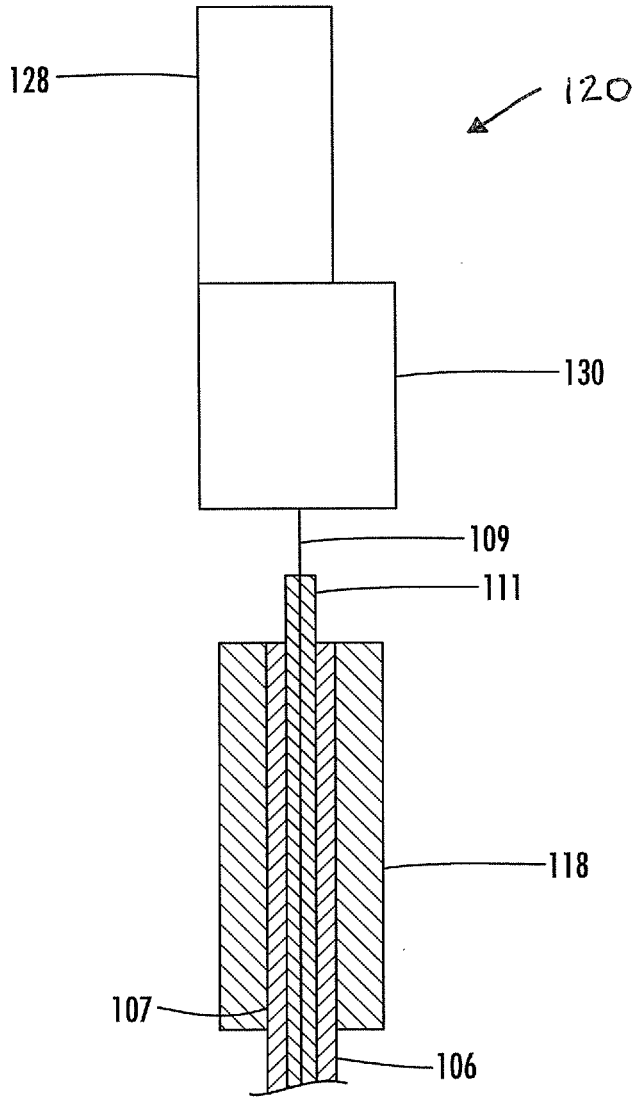
FIG. 26 is a schematic view of the internal construction shown in FIG. 6 of the exemplary antenna assembly shown in FIG. 2 illustrating the components of the coaxial cable in section and coupled to the sleeve and antenna element.
Figures 27A, 27B, 27C, 27D, 27E:
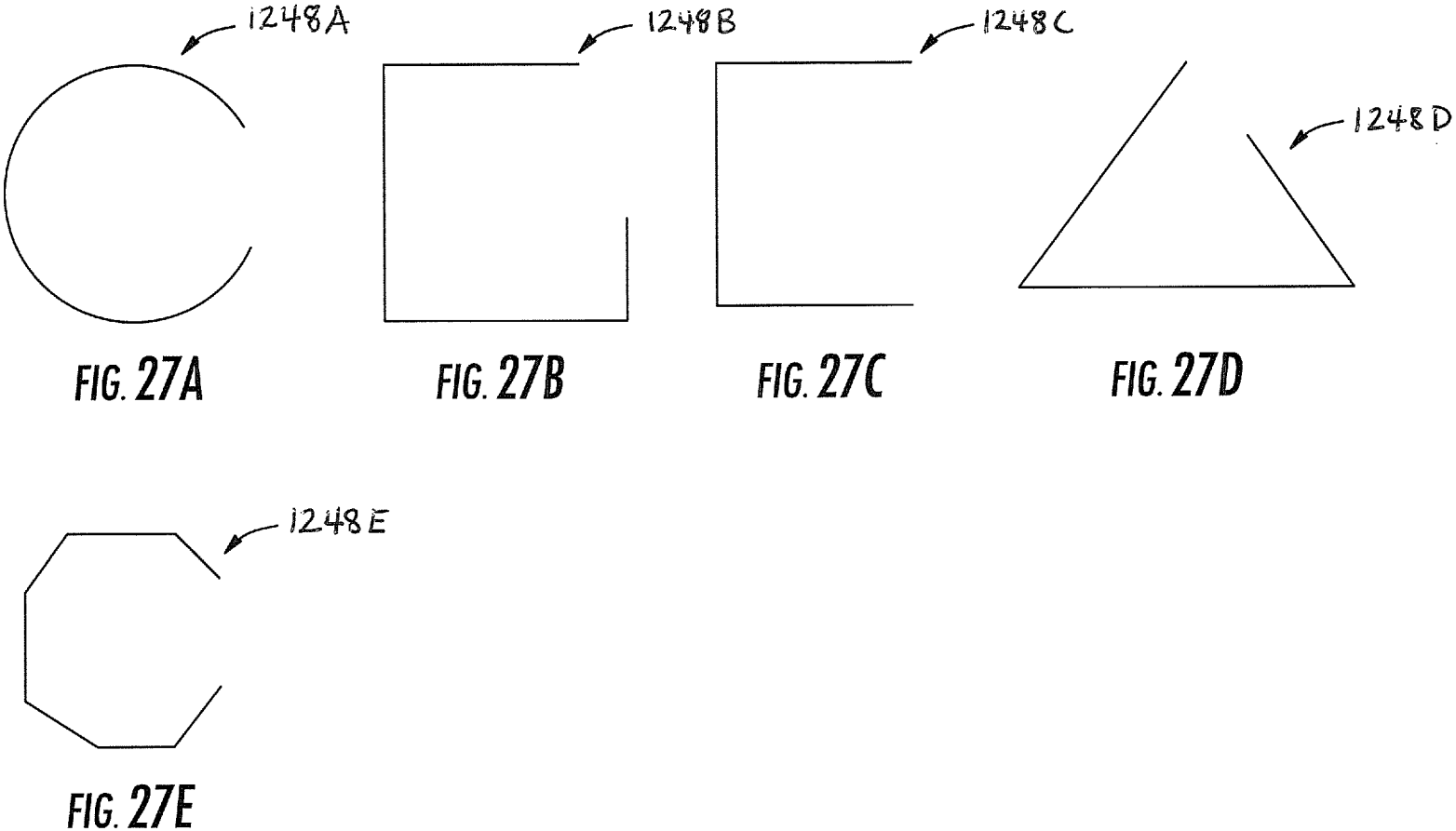
FIGS. 27A through 27E are schematic views of exemplary tubular cross-sectional shapes into which at least part of an antenna element may be formed according to exemplary embodiments of the present disclosure and used, for example, with the antenna assembly of FIG. 2.

The illustrated sleeve 118 is generally tubular in shape such that at least part of the sleeve 118 defines a generally non-solid (e.g., hollow, etc.) interior portion. More particularly, the illustrated sleeve 118 includes a generally cylindrical shape. At least part of the cable 106 extends through the sleeve 118 (e.g., through the generally non-solid interior portion of the sleeve 118, etc.). An inner portion 109 (e.g., inner conductor, core, etc.) of the cable 106 disposed within an insulator 111 of the cable 106 extends through the sleeve 118 and couples to the antenna element 120 adjacent the sleeve 118 (FIG. 26). In the assembled form of the antenna assembly 100 (FIGS. 2-4), the cover 104 fits over the sleeve 118 and antenna element 120 and secures to the chassis 102. For example, the cover 104 may snap fit to the chassis 102 (or the base 112, etc.). Alternatively, mechanical fasteners (e.g., screws, other fastening devices, etc.) or other suitable fastening methods/means may be used for securing the cover 104 to the chassis 102 (or the base 112, etc.) within the scope of the present disclosure.

The illustrated wrap 122 (FIG. 5) includes a heat shrink wrap coupling the antenna element 120 to the sleeve 118. The heat shrink wrap may include, for example, a thermoplastic material such as polyolefin, fluoropolymer, polyvinyl chloride, neoprene, silicone elastomer, VITON, etc. The antenna element 120 may be coupled to the sleeve 118 differently than disclosed herein within the scope of the present disclosure.

The illustrated antenna element 120 includes an elongated, generally non-solid, hollow or tubular-shaped body 126 (e.g., a metallic non-solid body, a non-closed cross-sectionally shaped body, etc.) having first and second generally non-solid, hollow, or tubular-shaped radiating elements 128 and 130 (or conductors, etc.). Together, the first and second radiating elements 128 and 130 are integrally, monolithically, etc. defined at least partly by the body 126 of the antenna assembly 100. The first radiating element 128 is generally longer than the second radiating element 130 and extends generally beyond the second radiating element 130. As such, a longitudinal length dimension of the first radiating element 128 is generally longer than a corresponding longitudinal length dimension of the second radiating element 130. In the illustrated embodiment, the first antenna element 128 includes an exemplary longitudinal length dimension L2 (FIG. 9) of about 31.0 millimeters, and the second antenna element 130 includes an exemplary longitudinal length dimension L4 (FIG. 9) of about 14.2 millimeters. In some embodiments, the sleeve 118 and the body 126 are configured such that each has a length of about $\lambda/4$ of the lower frequency band associated with the longer, first radiating element 128 (e.g., one-fourth wavelength at about 2400 MHz and about 2500 MHz, etc.). Alternative configurations are possible for the sleeve 118 and body 126.

The illustrated radiating elements 128 and 130 of the antenna element 120 each include a generally rounded outer perimeter 132 and 134 (e.g., a generally rounded outer perimeter surface, a rounded outer shape, etc.) and share a common longitudinal axis A. And, the radiating elements 128 and 130 each include a generally tubular-shaped cross-section. As such, at least part of the illustrated radiating elements 128 and 130 have a non-planar (e.g., not flat, etc.) construction defining a generally non-solid interior portion of the radiating elements 128 and 130. The shape modifications of the radiating elements 128 and 130 help contribute to the multi-band characteristic of the antenna element 120. And, the shapes of the radiating elements 128 and 130 may be modified to help optimize the multi-band characteristics.

Figure 7:
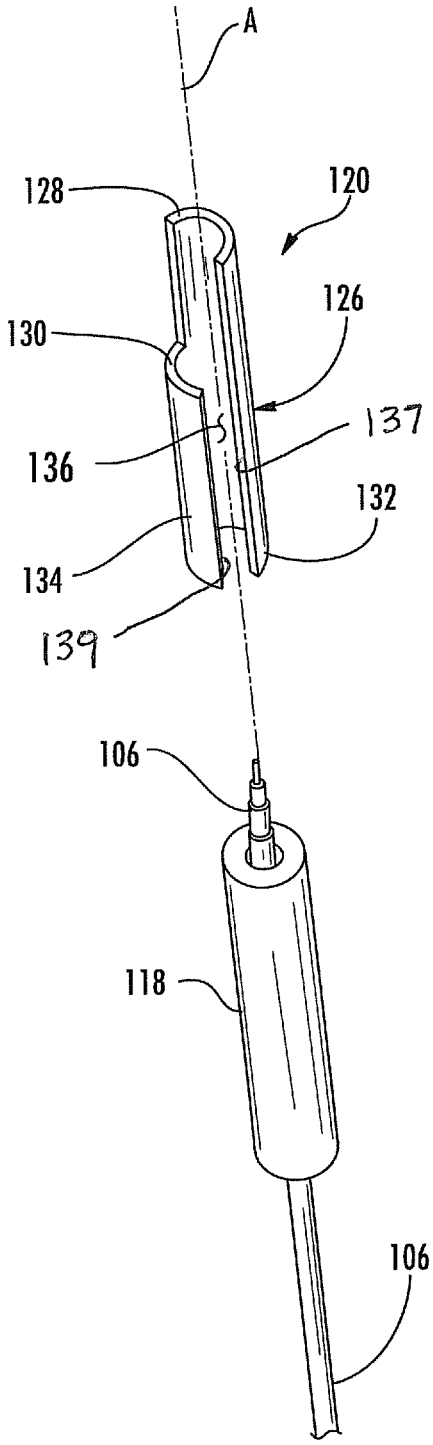
FIG. 7 is an exploded perspective view similar to FIG. 6 with the antenna element of the antenna assembly moved away from the sleeve and coaxial cable of the antenna assembly.

The outer perimeters 132 and 134 of the radiating elements 128 and 130 do not completely encircle the antenna element 120, and an open slot 136 (or gap, opening, etc.) is defined generally between the second radiating element 130 and at least part of the first radiating element 128 (FIG. 7). As such, at least part of the radiating elements 128 and/or 130 may be viewed, for example, as defining a partial cylinder shape where a side portion of the cylinder shape includes the open slot 136 such that the side portion is generally open (e.g., a rolled shape defining a generally incomplete tube with the open slot 136 defined between opposing side edge portions, etc.). More particularly, spaced apart longitudinal edge portions 137 and 139 (FIG. 7) of the antenna element body 126 define the open slot 136 therebetween. Longitudinal edge portion 137 defines at least part of the first radiating element 128, and longitudinal edge portion 139 defines at least part of the second radiating element 130. In the illustrated embodiment, the open slot 136 extends generally along a longitudinal length of the antenna element body 126. The open slot 136 may be configured to provide impedance matching for the antenna assembly 100 especially for the high frequency band. Increasing the gap 136 also may shorten the electrical length of radiating elements subsequently shifting the high band to higher frequency.

Figure 10:
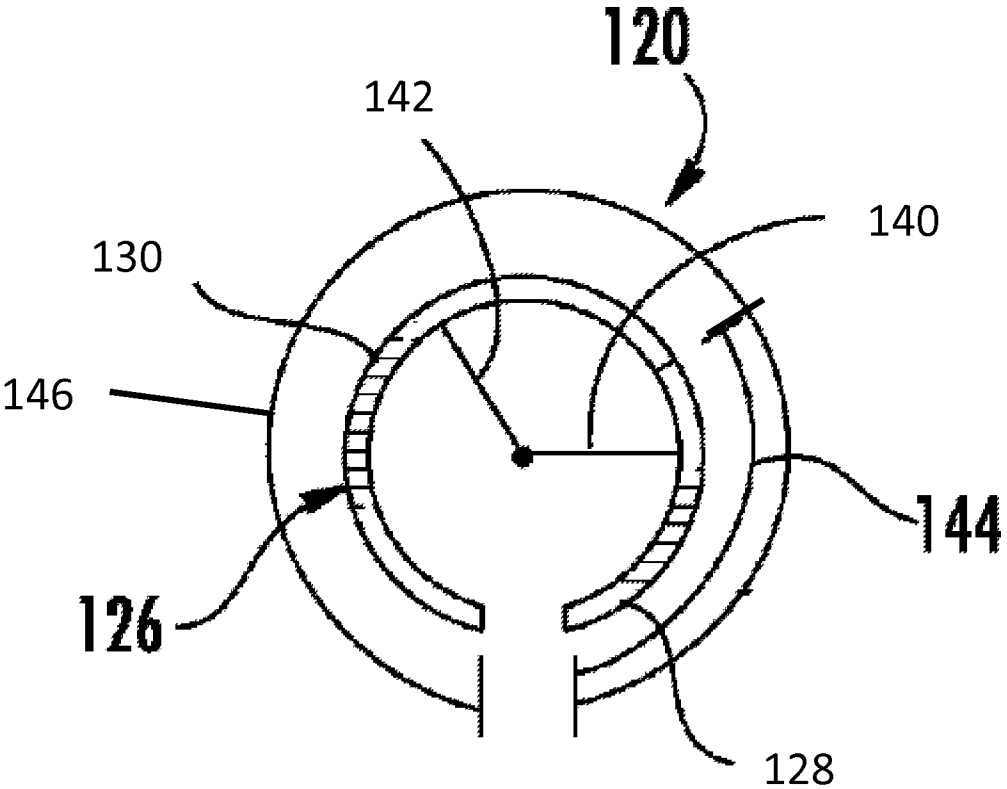
FIG. 10 is a top plan view of the antenna element of FIG. 9.

The generally rounded outer perimeter 132 of the first radiating element 128 is generally coextensive, uniform, etc. with the generally rounded outer perimeter 134 of the second radiating element 130. Each of the radiating elements' rounded outer perimeters 132 and 134 generally include a radius of curvature 140 and 142 (respectively) as well as a circumferential dimension 144 and 146 (respectively) around the outer perimeter 132 and 134 (FIG. 10). In the illustrated embodiment, the radius of curvature 140 of the first radiating element 128 is substantially the same as the radius of curvature 142 of the second radiating element 130, and the circumferential dimension 144 of the first radiating element 128 is generally less than the corresponding circumferential dimension 146 of the second radiating element 130 (FIG. 10). For example, in the illustrated embodiment, each of the first and second radiating elements 128 and 130 includes an exemplary radius of curvature 140 and 142 of about 2.3 millimeters. And, the first antenna element 128 includes an exemplary circumferential dimension 144 of about 8.5 millimeters, and the second antenna element 130 includes an exemplary circumferential dimension 146 of about 13.4 millimeters.

In the illustrated antenna element 120, the first, longer radiating element 128 is preferably tuned to receive electrical resonance frequencies over a bandwidth ranging between about 2400 MHz and about 2500 MHz, including those frequencies generally associated with wireless local area networks. The second, shorter radiating element 130 is preferably tuned to receive electrical resonance frequencies over a bandwidth ranging between about 4900 MHz and about 5850 MHz, including those higher frequencies also associated with wireless local area networks. Accordingly, the disclosed antenna element 120 is tuned for operating at frequencies within two distinct or non-overlapping bandwidths. That is, the disclosed antenna element 120 is tuned for operating at frequencies within one bandwidth ranging between about 2400 MHz and about 2500 MHz, and is also tuned for operating at frequencies within another bandwidth ranging between about 4900 MHz and about 5850 MHz. It should thus be appreciated that the disclosed antenna element 120 is capable of wideband operation, receiving bands of radio frequencies substantially covering the different wireless local area network standards currently in use. In other exemplary embodiments, antenna assemblies may be tuned for operating at frequencies within one or more bandwidths having different frequency ranges than disclosed herein.

Figure 9:
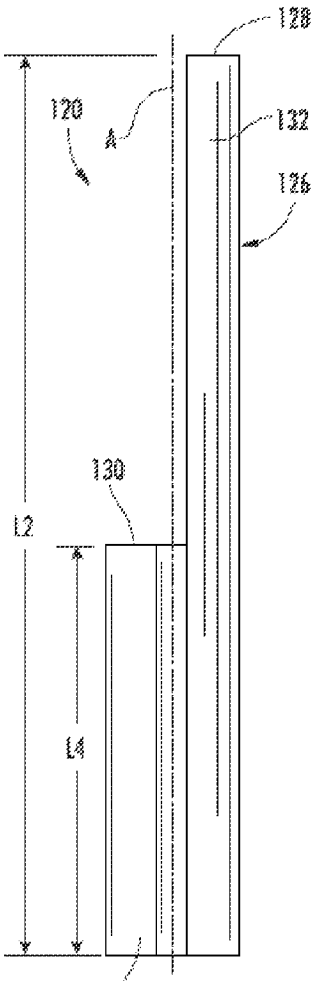
FIG. 9 is a front elevation view of the antenna element of FIG. 8 after being rolled into the generally tubular configuration.
Figure 8:
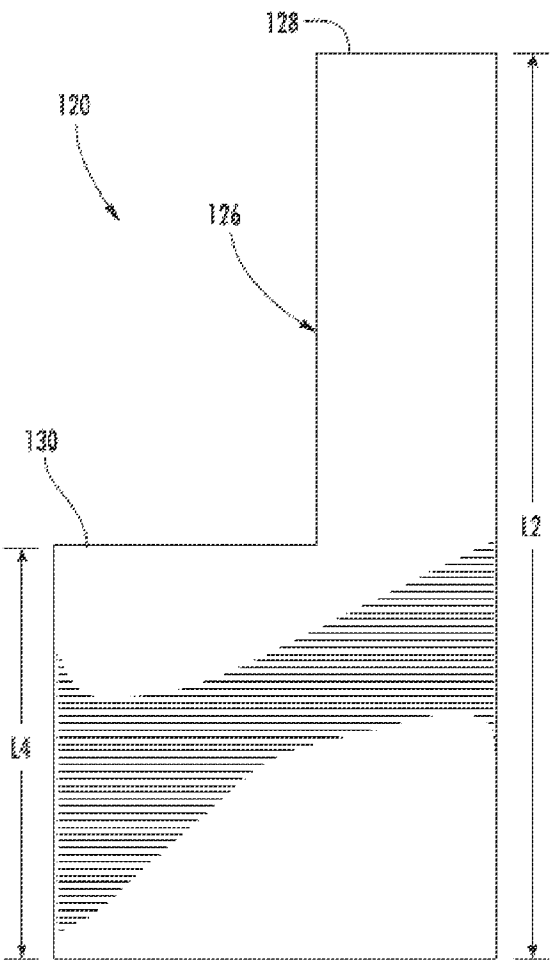
FIG. 8 is a front elevation view of the antenna element of the antenna assembly of FIG. 2 after being, for example, stamped from a sheet of material and before being, for example, rolled into a generally tubular configuration as illustrated in FIG. 7.

With reference now to FIGS. 8 through 10, a description will now be provided of an exemplary operation by which the illustrated antenna element 120 may be formed. The antenna element 120 is initially formed (e.g., stamped, cut, etc.) from a sheet of material to generally define the body 126 of the antenna element 120. As shown in FIG. 8, the formed body 126 is generally flat and relatively thin, and includes the first and second radiating elements 128 and 130 in generally flat form.

The antenna element 120 is preferably formed by a stamping process using, for example, a press tool to punch the desired antenna element 120 shape from a sheet of material. The stamping process monolithically or integrally forms the first and second radiating elements 128 and 130 of the antenna element 120 as one piece of material. The sheet of material may be prepared from 25-gauge thickness AISI 1006 steel. In other exemplary embodiments, a sheet of material may be prepared from materials including copper, brass, bronze, nickel silver, stainless steel, phosphorous bronze, beryllium cu etc., or other suitable electrically-conductive material.

After the body 126 of the antenna element 120 is formed from a sheet of material, the body 126 is then configured, or formed, (e.g., rolled, drawn, folded, bent, etc.) into a generally tubular shape (FIGS. 9 and 10) such that at least part of the body 126 includes a generally non-solid interior portion. For example, the generally flat body 126 may be rolled into a generally tubular shape such that the outer perimeter of the body 126 is generally rounded, and generally tubular in shape (and such that the body 126 includes the generally non-solid interior portion). Antenna bodies may be configured, or formed, into generally tubular shapes other than those that are generally round in shape, such as, for example, generally square shapes, rectangular shapes, hexagonal shapes, triangular shapes, octagonal shapes, octagonal shapes, other closed or open cross-sectional shapes, shapes such as an English alphabetic letter C or U, etc. within the scope of the present disclosure. By way of further example, FIGS. 27A through 27E schematically illustrate additional exemplary tubular cross-sectional shapes 1248A, 1248B, 1248C, 1248D, 1248E, respectively, into which at least part of an antenna element body may be configured, or formed.

Figure 11:
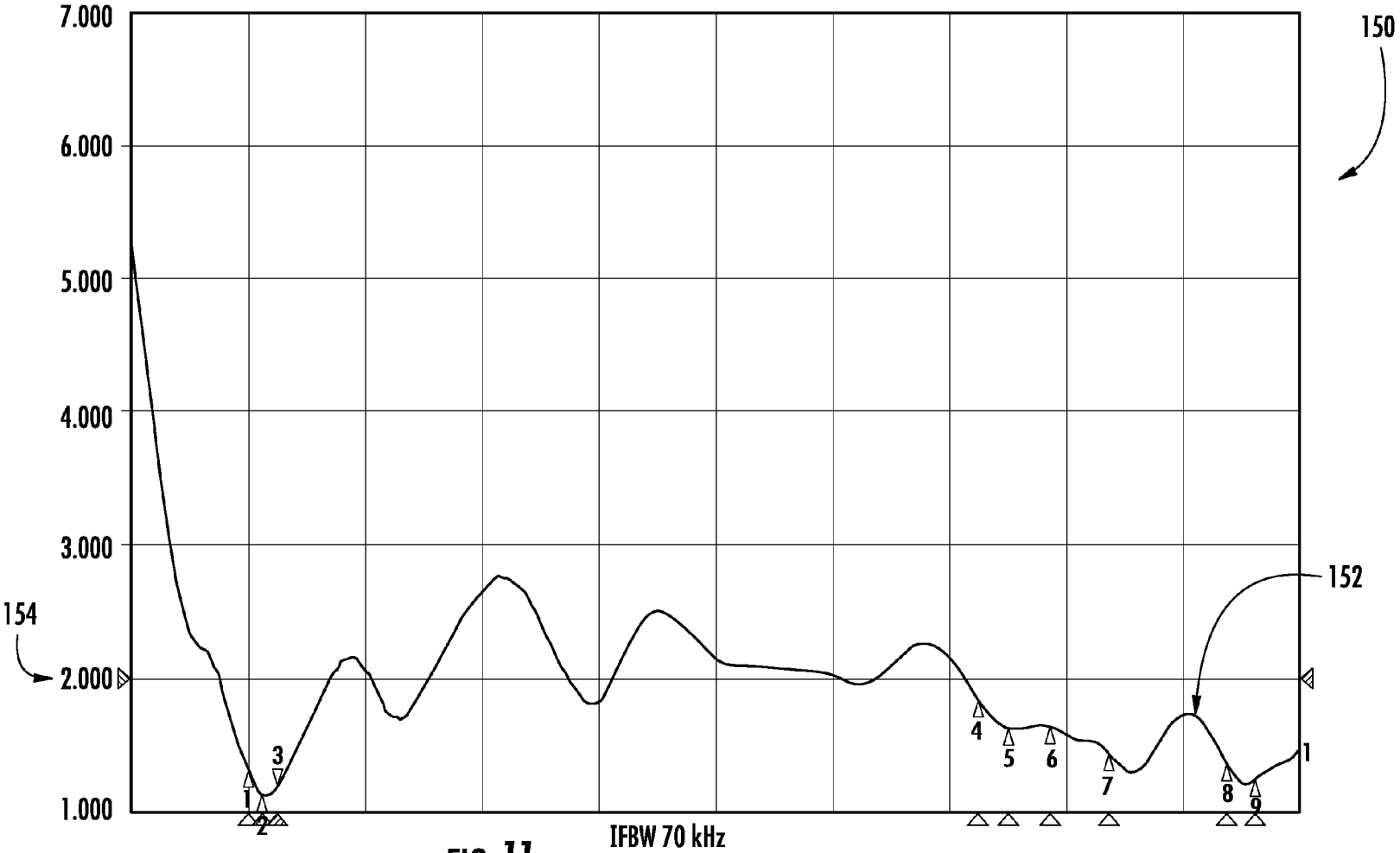
FIG. 11 is a line graph illustrating voltage standing wave ratios (VSWRs) for the exemplary antenna assembly shown in FIG. 2 over a frequency bandwidth of about 2000 MHz to about 6000 MHz and with an intermediate frequency bandwidth (IFBW) of about 70 kHz.

With reference now to FIG. 11, voltage standing wave ratios (VSWRs) are illustrated in graph 150 by graphed line 152 for the exemplary antenna assembly 100 described above and illustrated in FIGS. 2-10 over a frequency bandwidth of about 2000 MHz to about 6000 MHz and with an intermediate frequency bandwidth (IFBW) of about 70 kHz.

As shown in FIG. 11, the antenna element 120 of the antenna assembly 100 will operate at frequencies within a bandwidth ranging from about 2400 MHz to about 2500 MHz and at frequencies within a bandwidth ranging from about 4900 MHz to about 5850 MHz with a VSWR of about 2:1 or less. Reference numeral 154 indicates locations on the graph 150 below which the antenna assembly 100 has a VSWR of 2:1. Table 1 identifies some exemplary VSWR at different frequencies at the nine reference locations shown in FIG. 11.

TABLE 1

Exemplary Voltage Standing Wave Ratios (VSWR)

| Reference Point | Frequency (MHz) | VSWR |
|---|---|---|
| 1 | 2400 | 1.3051:1 |
| 2 | 2450 | 1.1290:1 |
| 3 | 2500 | 1.1906:1 |
| 4 | 4900 | 1.8324:1 |
| 5 | 5000 | 1.6244:1 |
| 6 | 5150 | 1.6341:1 |
| 7 | 5350 | 1.4292:1 |
| 8 | 5750 | 1.3591:1 |
| 9 | 5850 | 1.2407:1 |

Figure 12:
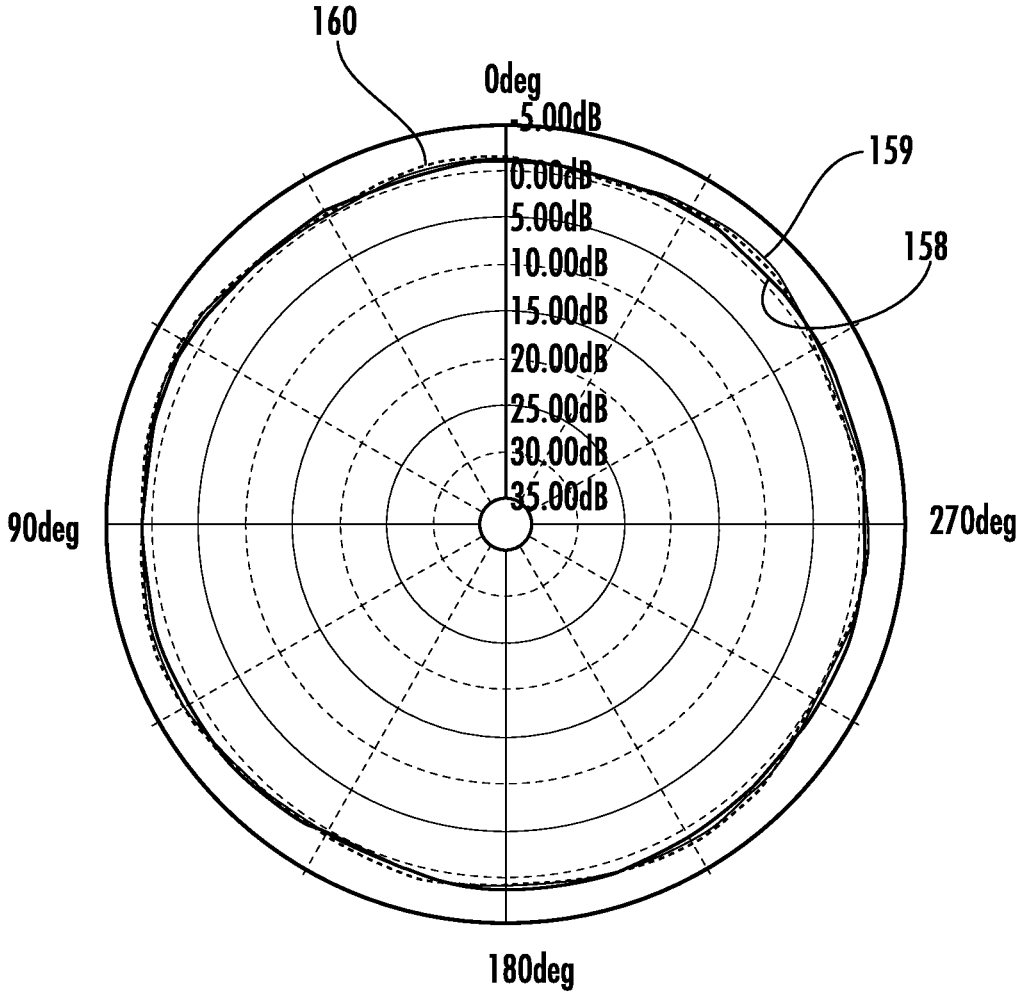
FIG. 12 illustrates H-plane (azimuth) radiation patterns for the exemplary antenna assembly shown in FIG. 2 for frequencies of about 2400 MHz, about 2450 MHz, and about 2500 MHz.
Figure 13:
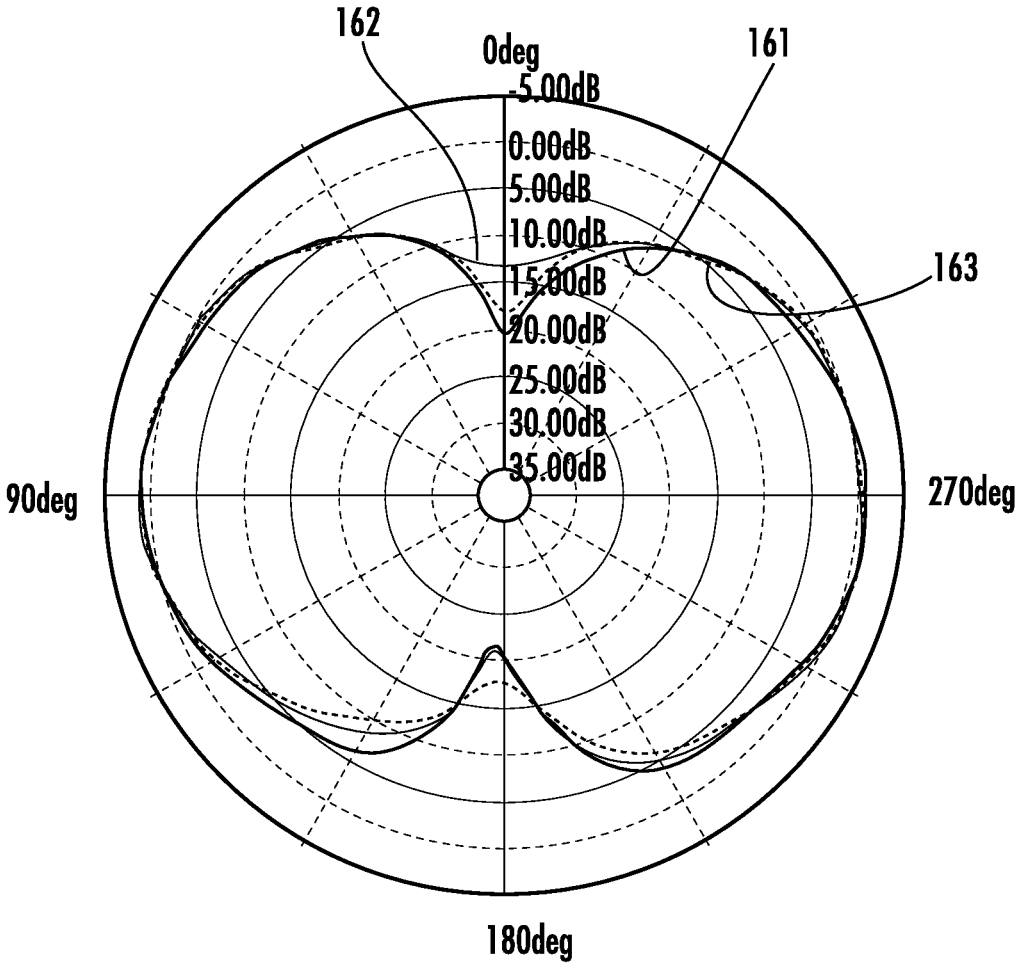
FIG. 13 illustrates E-plane (elevation) radiation patterns for the exemplary antenna assembly shown in FIG. 2 for frequencies of about 2400 MHz, about 2450 MHz, and about 2500 MHz.

With reference now to FIGS. 12 through 15, exemplary measured radiation patterns for gain are shown for the antenna assembly 100 described above and illustrated in FIGS. 2-10. FIG. 12 illustrates exemplary measured H-Plane (azimuth) radiation patterns for gain at frequencies of about 2400 MHz, about 2450 MHz, and about 2500 MHz at reference numbers 158, 159, and 160, respectively. FIG. 13 illustrates exemplary measured E-Plane (elevation) radiation patterns for gain at frequencies of about 2400 MHz, about 2450 MHz, and about 2500 MHz at reference numbers 161, 162, and 163, respectively.

Figure 14:
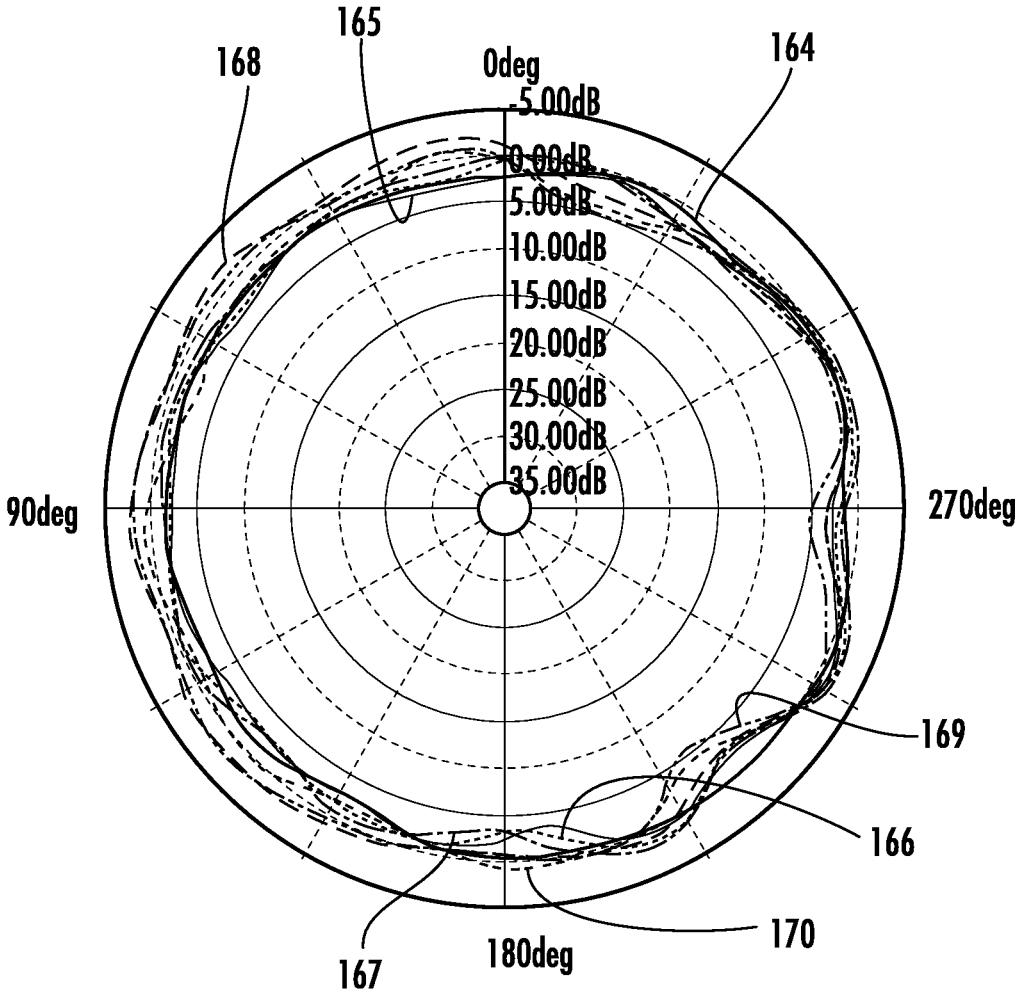
FIG. 14 illustrates H-plane (azimuth) radiation patterns for the exemplary antenna assembly shown in FIG. 2 for select frequencies between about 4900 MHz and about 5875 MHz.
Figure 15:
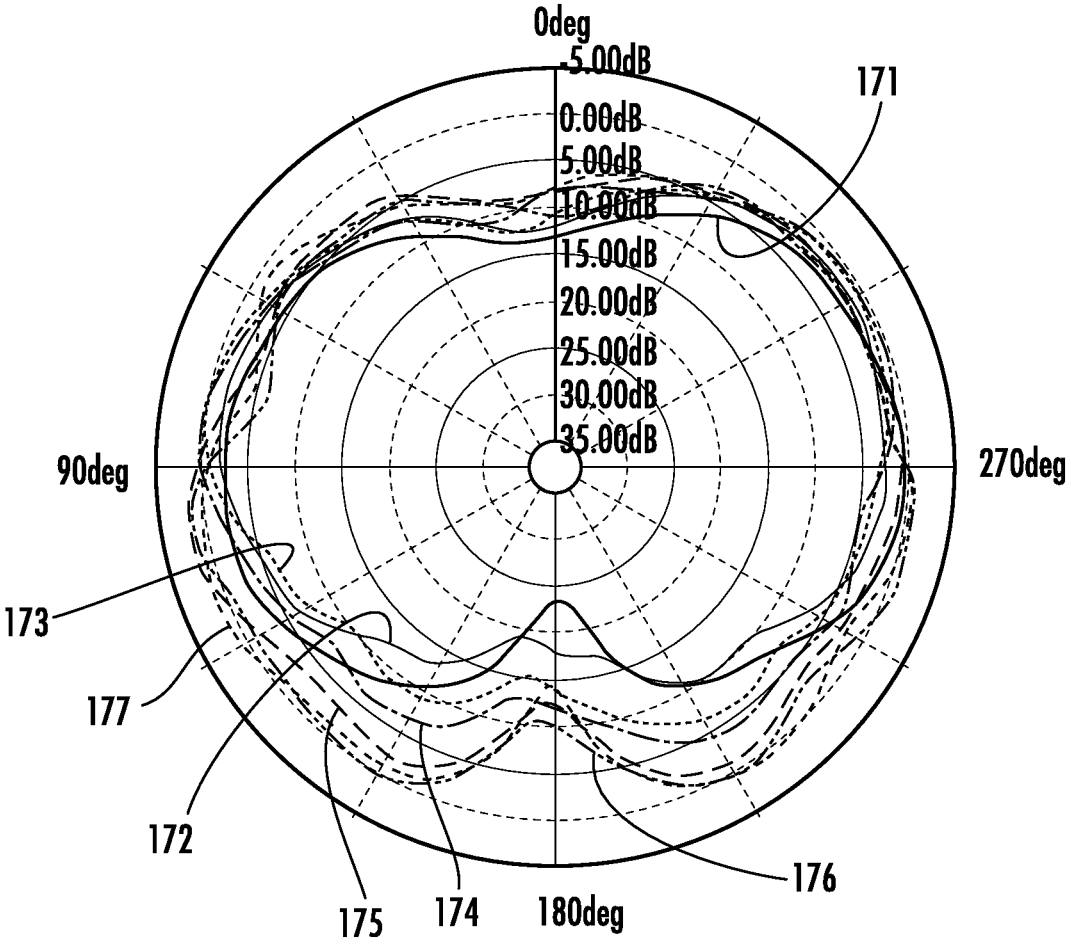
FIG. 15 illustrates E-plane (elevation) radiation patterns for the exemplary antenna assembly shown in FIG. 2 for select frequencies between about 4900 MHz and about 5875 MHz.
Figure 16:
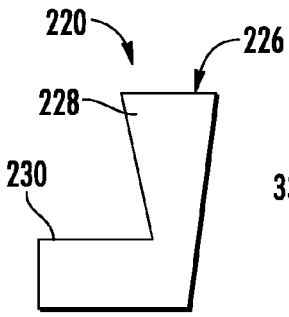
FIGS. 16 through 23 are front elevation views of different exemplary antenna elements suitable for use, for example, with the antenna assembly of FIG. 2 after being, for example, stamped from a sheet of material and before being, for example, rolled to a desired shape, for example, a generally tubular shape, etc.
Figure 17:
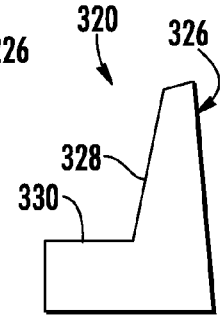
Figure 18:
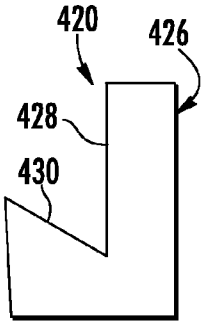
Figure 19:
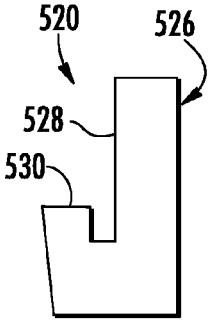
Figure 20:
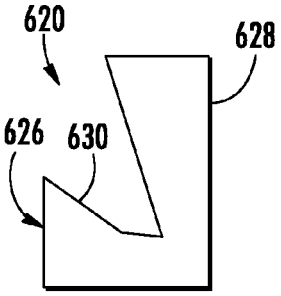
Figure 21:
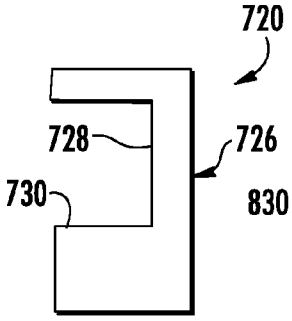
Figure 22:
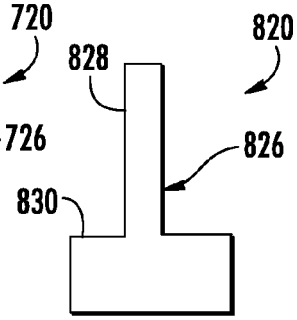
Figure 23:
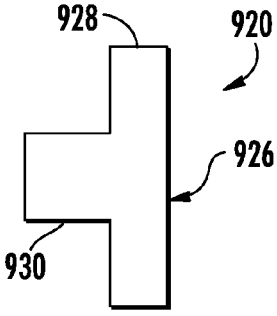

FIG. 14 illustrates exemplary measured H-Plane (azimuth) radiation patterns for gain for select frequencies between about 4900 MHz and about 5875 MHz, for example about 4900 MHz, 5150 MHz, 5250 MHz, 5350 MHz, 5750 MHz, 5850 MHz, and 5875 MHz at reference numbers 164, 165, 166, 167, 168, 169, and 170, respectively. FIG. 15 illustrates exemplary measured E-Plane (elevation) radiation patterns for gain for select frequencies between about 4900 MHz and about 5875 MHz, for example about 4900 MHz, 5150 MHz, 5250 MHz, 5350 MHz, 5750 MHz, 5850 MHz, and 5875 MHz at reference numbers 171, 172, 173, 174, 175, 176, and 177, respectively.

FIGS. 16 through 23 illustrate different exemplary antenna elements 220, 320, 420, 520, 620, 720, 820, and 920 (respectively) suitable for use with an antenna assembly (e.g., the antenna assembly 100 described above and illustrated in FIGS. 2-10, etc.). The exemplary antenna elements 220, 320, 420, 520, 620, 720, 820, and 920 are each shown after a body 226, 326, 426, 526, 626, 726, 826, and 926 (respectively) is formed (e.g., stamped, cut, etc.) from a sheet of material, but before the body 226, 326, 426, 526, 626, 726, 826, and 926 (respectively) is configured, or formed, (e.g., rolled, drawn, folded, bent, etc.) to a final desired shape, for example, where at least part of the body 226, 326, 426, 526, 626, 726, 826, and 926 is generally tubular in shape (e.g., a generally cylindrical shape, a generally square shape, a generally hexagonal shape, a generally triangular shape, a generally octagonal shape, a generally octagonal shape, other closed or open cross-sectional shapes, shapes such as an English alphabetic letter C or U, any of the tubular cross-sectional shapes 1248A, 1248B, 1248C, 1248D, 1248E shown respectively in FIGS. 27A through 27E, etc.). As can be seen, each antenna element body 226, 326, 426, 526, 626, 726, 826, and 926 includes a first radiating element 228, 328, 428, 528, 628, 728, 828, and 928 (respectively) and a second radiating element 230, 330, 430, 530, 630, 730, 830, and 930 (respectively) formed (e.g., integrally, monolithically, etc.) as part of the body 226, 326, 426, 526, 626, 726, 826, and 926 (respectively).

Figure 24:
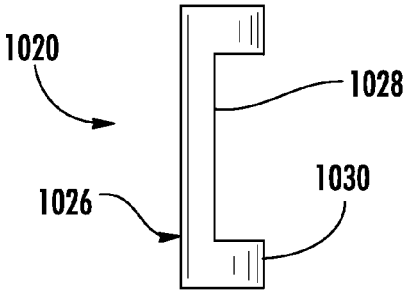
FIGS. 24 and 25 are side elevation views of further exemplary antenna elements suitable for use, for example, with the antenna assembly of FIG. 2.
Figure 25:
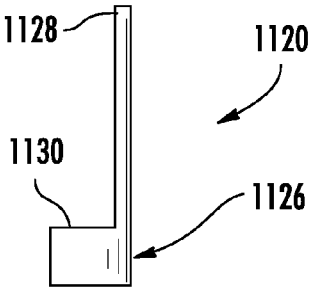

FIGS. 24 and 25 illustrate additional different exemplary antenna elements 1020 and 1120 (respectively) suitable for use with an antenna assembly (e.g., the antenna assembly 100 described above and illustrated in FIGS. 2-10, etc.). Here, the antenna elements 1020 and 1120 each include a generally tubular body 1026 and 1126 (respectively) from which a portion is removed (e.g., cut, etc.) to form a first radiating element 1028 and 1128 (respectively) and a second radiating element 1030 and 1130 (respectively). To form these antenna elements 1020 and 1120, for example, a sheet of material may initially be formed (e.g., rolled, etc.) to form the tubular body 1026 and 1126 (respectively), and a portion of the body 1026 and 1126 (respectively) then cut away to form the first radiating elements 1028 and 1128 (respectively) and second radiating elements 1030 and 1130 (respectively). Alternatively, a tube shaped material may be initially cut to a desired length to form tubular-shaped bodies, and a portion of each tubular-shaped body then cut away to form a first and second radiating element.

Figure 29:
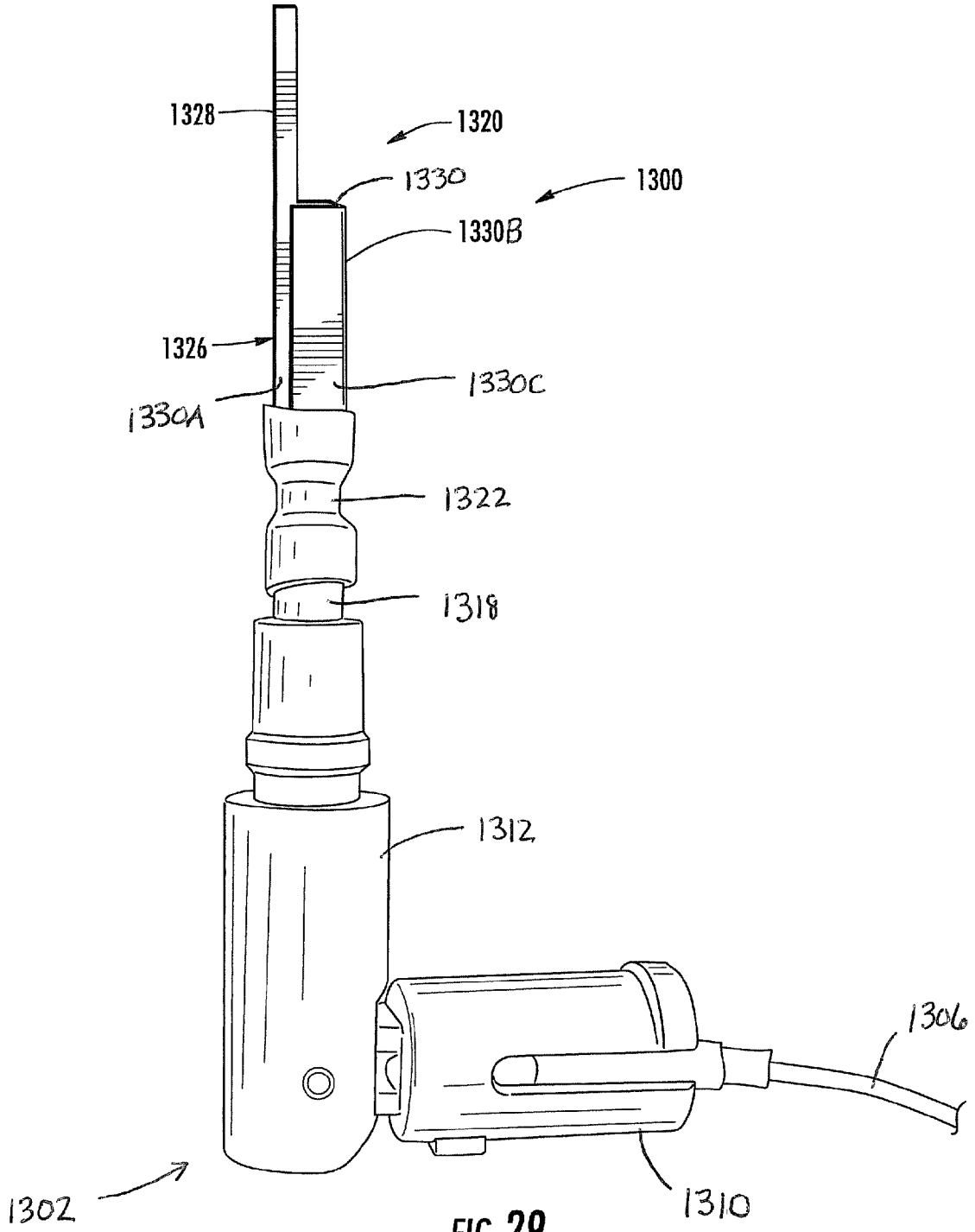
FIG. 29 is a side perspective view of the antenna assembly of FIG. 28.
Figure 30:
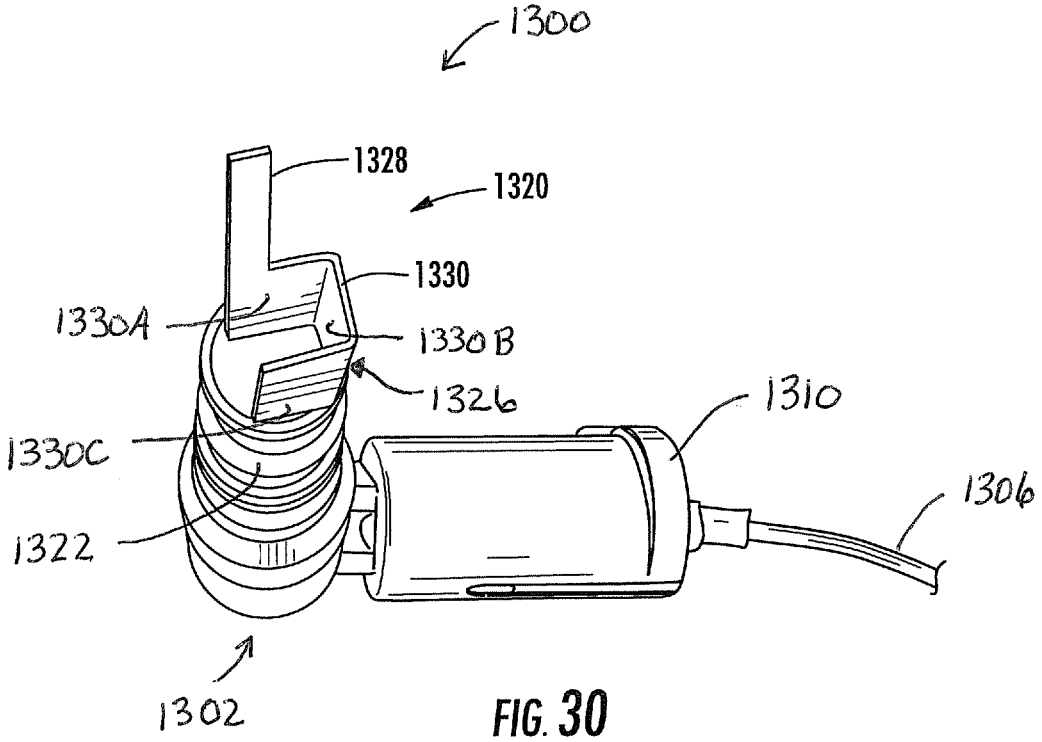
FIG. 30 is an upper perspective view of the antenna assembly of FIG. 28.
Figure 37:
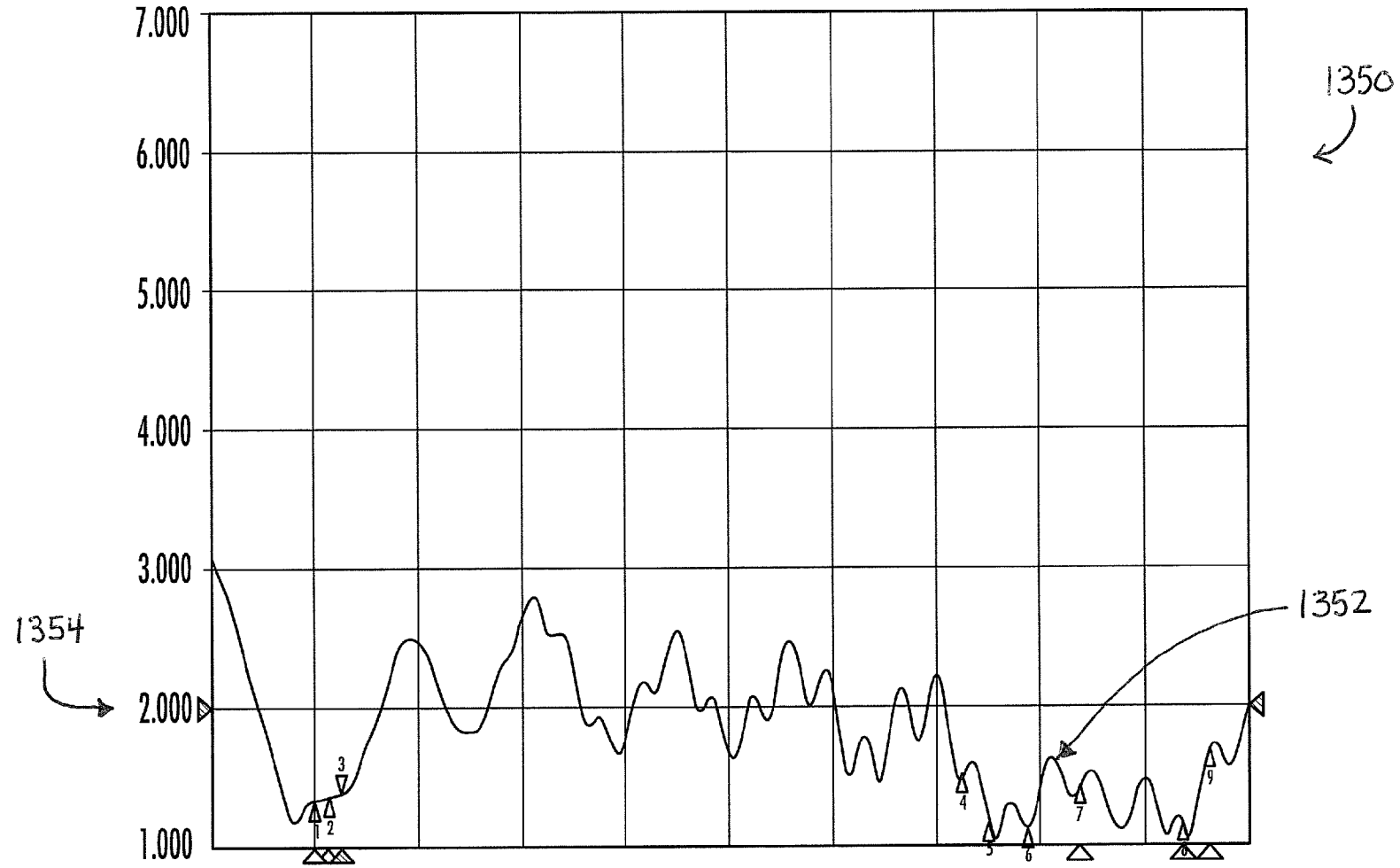

FIGS. 28 through 30 illustrate another exemplary multi-band sleeve antenna assembly 1300 embodying one or more aspects of the present disclosure. The illustrated antenna assembly 1300 is similar to the antenna assembly 100 previously described and illustrated in FIGS. 2 through 10. The antenna assembly 1300 generally includes a chassis 1302, a cover (not shown), and a coaxial cable 1306. The chassis 1302 includes a mount 1310 configured (e.g., sized, shaped, constructed, etc.) to couple the antenna assembly 1300 to a wireless application device, and a base 1312 configured to support components of the antenna assembly above the base 1312. The antenna assembly 1300 also generally includes a metallic sleeve 1318, an antenna element 1320 located generally upwardly of the sleeve 1318, and a wrap 1322 coupling the antenna element 1320 to the sleeve 1318. The coaxial cable 1306 extends generally away from the chassis 1302 and electrically couples the antenna assembly 1300 (and more particularly, the sleeve 1318 and the antenna element 1320 thereof) to the wireless application device.

In this embodiment, the antenna element 1320 of the antenna assembly 1300 includes an elongated, generally non-solid, hollow, generally tubular-shaped body 1326 (e.g., a metallic non-solid body, a non-closed cross-sectionally shaped body, etc.) having a generally flat, planar first radiating element 1328 (or conductor, etc.) and a generally square, box-shaped second radiating element 1330 (or conductor, etc.). As such, the second radiating element 1330 includes a generally square, tubular-shaped cross-section (e.g., a generally box-shaped cross-section, etc.) that helps define a generally square, tubular shape of the antenna element 1320. The second radiating element 1330 includes first, second, and third generally flat sides 1330A, 1330B, and 1330C (respectively) defining the second radiating element's generally box-shape. The first side 1330A is oriented generally parallel to the third side 1330C, and the second side 1330B is disposed generally between the first and third sides 1330A and 1330C and forms a generally right angle (e.g., a generally ninety degree angle, etc.) with each of the first and second sides 1330A and 1330C. As such, the antenna element 1320 includes an outer perimeter defining at least one generally right angle. The first side 1330A is also spaced apart from the third side 1330C such that an open slot 1336 (or gap, opening, etc.) is defined generally therebetween and opposite the second side 1330B. More particularly, spaced apart longitudinal edge portions 1337 and 1339 of the antenna element body 1326 define the open slot 1336 therebetween (FIG. 28). Longitudinal edge portion 1337 defines at least part of the first radiating element 1328, and longitudinal edge portion 1339 defines at least part of the second radiating element 1330. As such, an outer perimeter of the body 1326 (extending generally transversely) does not completely extend around the body 1326 because of the open slot 1336. The open slot 1336 may be configured to provide impedance matching for the antenna assembly 1300 especially for the high frequency band. Increasing the gap 1336 also may shorten the electrical length of radiating elements subsequently shifting the high band to higher frequency.

The first and second radiating elements 1328 and 1330 are integrally, monolithically, etc. defined at least partly by the body 1326 of the antenna element 1320. The generally flat, planar first radiating element 1328 is generally coextensive, coplanar, uniform, etc. with the second radiating element's first side 1330A and extends generally beyond the first side 1330A. Thus, the second radiating element's first side 1330A defines at least part of the first radiating element 1328 such that the first radiating element 1328 is generally longitudinally longer than the second radiating element 1330. In addition, it can be seen that the open slot 1336 is thus generally defined at least partly between the first radiating element 1328 and the second radiating element 1330.

In the illustrated antenna element 1320, the first, longer radiating element 1328 is preferably tuned to receive electrical resonance frequencies over a bandwidth ranging between about 2400 MHz and about 2500 MHz, including those frequencies generally associated with wireless local area networks. The second, shorter radiating element 1330 is preferably tuned to receive electrical resonance frequencies over a bandwidth ranging between about 4900 MHz and about 5850 MHz, including those higher frequencies also associated with wireless local area networks. Accordingly, the disclosed antenna element 1320 is tuned for operating at frequencies within two distinct or non-overlapping bandwidths. That is, the disclosed antenna element 1320 is tuned for operating at frequencies within one bandwidth ranging between about 2400 MHz and about 2500 MHz, and is also tuned for operating at frequencies within another bandwidth ranging between about 4900 MHz and about 5850 MHz. It should thus be appreciated that the disclosed antenna element 1320 is capable of wideband operation, receiving bands of radio frequencies substantially covering the different wireless local area network standards currently in use. In other exemplary embodiments, antenna assemblies may be tuned for operating at frequencies within one or more bandwidths having different frequency ranges than disclosed herein.

The antenna element 1320 is initially formed (e.g., stamped, cut, etc.) from a sheet of material to generally define the body 1326 of the antenna element 1320. The formed body 1326 is generally flat and relatively thin, and includes the first and second radiating elements 1328 and 1330 in generally flat form. After the body 1326 of the antenna element 1320 is formed, it is then configured, or formed, (e.g., rolled, drawn, folded, bent, etc.) into a generally tubular shape such that the second radiating element 1330 has the generally box shape and the first radiating element is generally flat and coplanar with the first side 1330A of the second radiating element 1330. Here, an outer perimeter of at least the second radiating element 1330 includes a generally tubular shape, helping define the generally tubular shape of the antenna element 1320.

With reference now to FIG. 31, voltage standing wave ratios (VSWRs) are illustrated in graph 1350 by graphed line 1352 for the exemplary antenna assembly 1300 described above and illustrated in FIGS. 28-30 over a frequency bandwidth of about 2000 MHz to about 6000 MHz and with an intermediate frequency bandwidth (IFBW) of about 70 kHz. In FIG. 31, the VSWRs are determined for the antenna assembly 1300 without a ferrite bead (also, a ferrite core, etc.) provided along the cable 1306 to help suppress electromagnetic interference (EMI).

As shown in FIG. 31, the antenna element 1320 of the antenna assembly 1300 (without inclusion of a ferrite bead) will operate at frequencies within a bandwidth ranging from about 2400 MHz to about 2500 MHz and at frequencies within a bandwidth ranging from about 4900 MHz to about 5850 MHz with a VSWR of about 2:1 or less. Reference numeral 1354 indicates locations on the graph 1350 below which the antenna assembly 1300 (without inclusion of a ferrite bead) has a VSWR of 2:1. Table 2 identifies some exemplary VSWR at different frequencies at the nine reference locations shown in FIG. 31.

TABLE 2

Exemplary Voltage Standing Wave Ratios (VSWR)

| Reference Point | Frequency (MHz) | VSWR |
|---|---|---|
| 1 | 2400 | 1.3334:1 |
| 2 | 2450 | 1.3655:1 |
| 3 | 2500 | 1.3833:1 |
| 4 | 4900 | 1.5096:1 |
| 5 | 5000 | 1.1657:1 |
| 6 | 5150 | 1.1321:1 |
| 7 | 5350 | 1.4237:1 |
| 8 | 5750 | 1.1530:1 |
| 9 | 5850 | 1.6887:1 |

With reference to FIG. 32, voltage standing wave ratios (VSWRs) are again illustrated in graph 1450 by graphed line 1452 for the exemplary antenna assembly 1300 described above and illustrated in FIGS. 28-30 over a frequency bandwidth of about 2000 MHz to about 6000 MHz and with an intermediate frequency bandwidth (IFBW) of about 70 kHz. In FIG. 32, however, the VSWRs are determined for the antenna assembly 1300 with a ferrite bead (also, a ferrite core, etc.) provided along the cable 1306 to help suppress electromagnetic interference (EMI).

As shown in FIG. 32, the antenna element 1320 of the antenna assembly 1300 (with inclusion of a ferrite bead) will operate at frequencies within a bandwidth ranging from about 2400 MHz to about 2500 MHz and at frequencies within a bandwidth ranging from about 4900 MHz to about 5850 MHz with a VSWR of about 2:1 or less. Reference numeral 1454 indicates locations on the graph 1450 below which the antenna assembly 1300 (with inclusion of a ferrite bead) has a VSWR of 2:1. Table 3 identifies some exemplary VSWR at different frequencies at the nine reference locations shown in FIG. 32.

TABLE 3

Exemplary Voltage Standing Wave Ratios (VSWR)

| Reference Point | Frequency (MHz) | VSWR |
|---|---|---|
| 1 | 2400 | 1.2747:1 |
| 2 | 2450 | 1.2887:1 |
| 3 | 2500 | 1.3113:1 |
| 4 | 4900 | 1.4809:1 |
| 5 | 5000 | 1.0602:1 |
| 6 | 5150 | 1.1213:1 |
| 7 | 5350 | 1.3550:1 |
| 8 | 5750 | 1.2349:1 |
| 9 | 5850 | 1.8197:1 |

According to various aspects, exemplary embodiments are provided of antenna elements for multi-band antenna assemblies for use with wireless application devices. One exemplary embodiment provides an antenna element for an antenna assembly that is configured to be installed to a wireless application device for WLAN application. In such embodiment, the antenna element generally includes first and second radiating elements, which may have a generally rounded outer perimeter. The first radiating element may be tuned to at least one electrical resonant frequency for operating within the frequency range of 2400 MHz to 2500 MHz. The second radiating element may be tuned to at least one electrical resonant frequency for operating within the frequency range from 4900 MHz to 5850 MHz.

Another exemplary embodiment provides an antenna assembly configured to be installed to a wireless application device. The antenna assembly generally includes a coaxial cable, a sleeve coupled to the coaxial cable, and an antenna element coupled to the coaxial cable adjacent the tubular sleeve. The antenna element includes a body having first and second radiating elements. The first radiating element is tuned for receiving electrical resonant frequencies within a first frequency range. The second radiating element is tuned for receiving electrical resonant frequencies within a second frequency range different from the first frequency range.

Another exemplary embodiment provides a stamped and formed metallic antenna element for an antenna assembly configured for installation to a wireless application device. The antenna element includes a metallic body having a first radiating element and a second radiating element. The first radiating element is generally tubular and tuned for receiving electrical resonant frequencies within a first frequency bandwidth. The second radiating element is generally tubular and tuned for receiving electrical resonant frequencies within a second frequency bandwidth different from the first frequency bandwidth.

Another exemplary embodiment provides a method of making an antenna element for an antenna assembly that is configured for installation to a wireless application device. In this embodiment, the method generally includes forming a body of an antenna element from a sheet of conductive material such that the body includes a first radiating element and a second radiating element. The method also includes forming the body such that an outer perimeter of at least a portion of the body is includes a generally tubular, hollow, and/or rounded shape. The forming of the sheet of conductive material is not limited to the round shape, as the sheet of conductive material may be formed into other shapes such as square, hexagonal, rectangular, triangular, octagonal, shaped as an English alphabetic letter C or U, etc.

Another exemplary embodiment provides an antenna element for an antenna assembly that is configured to be installed to a wireless application device. The antenna element includes a body having a first radiating element and a second radiating element. The first radiating element is generally flat in shape, and the second radiating element includes a generally square section.

Another exemplary embodiment provides an antenna element for an antenna assembly that is configured to be installed to a wireless application device. The antenna element includes a body having first and second radiating elements, wherein the body includes at least two spaced apart longitudinal edge portions defining a slot opening extending generally longitudinally along the body.

Another exemplary embodiment provides an antenna element for a multi-band sleeve dipole antenna assembly that is configured to be installed to a wireless application device. The antenna element generally includes a first radiating element tuned for receiving electrical resonant frequencies within a first frequency bandwidth, and a second radiating element tuned for receiving electrical resonant frequencies within a second frequency bandwidth different from the first frequency bandwidth. At least part of the first radiating element and/or at least part of the second radiating element have a non-planar construction defining a non-solid (e.g., generally hallow, etc.) interior portion. Whereby the first and second radiating elements are configured for use with a multi-band sleeve dipole antenna assembly.

Another exemplary embodiment provides a dipole antenna assembly configured to be installed to a wireless application device. The dipole antenna assembly generally includes a coaxial cable, a sleeve coupled to the coaxial cable, and an antenna element coupled to the coaxial cable adjacent the sleeve. The sleeve is operable as a ground for the dipole antenna assembly. And, the antenna element includes a first radiating element and a second radiating element. The first radiating element is tuned for receiving electrical resonant frequencies within a first frequency bandwidth and the second radiating element is tuned for receiving electrical resonant frequencies within a second frequency bandwidth different from the first frequency bandwidth.

Another exemplary embodiment provides a method of making an antenna element for a multi-band sleeve dipole antenna assembly that is configured for installation to a wireless application device. The method generally includes forming a body of an antenna element from a sheet of conductive material such that the body includes a first radiating element and a second radiating element, and forming the body of the antenna element such that at least part of the body includes a generally tubular shape.

Accordingly, there is disclosed various exemplary embodiments of antenna assemblies that may be used as multi-band sleeve dipole antennas for wireless application devices. Various exemplary embodiments may also provide for easier and more cost effective manufacturing processes. In those embodiments that include metallic tubular configurations, the metallic tubular antenna elements may also provide relatively good mechanical integrity.

Numerical dimensions, values, and specific materials are provided herein for illustrative purposes only. The particular dimensions, values and specific materials provided herein are not intended to limit the scope of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper,", "forward, "rearward," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Disclosure of values and/or ranges of values for specific parameters (such as dimensions, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

What is claimed is:

1. An antenna element for a multi-band sleeve dipole antenna assembly that is configured to be externally installed to a wireless application device, the antenna element comprising:

a body;

a first radiating element tuned for receiving electrical resonant frequencies within a first frequency bandwidth;

a second radiating element tuned for receiving electrical resonant frequencies within a second frequency bandwidth different from the first frequency bandwidth;

at least part of the first radiating element and/or at least part of the second radiating element having a non-planar construction defining a non-solid interior portion;

wherein the first and second radiating elements are integrally, monolithically defined at least partly by the body;

wherein the antenna element is stamped from a single sheet of conductive material forming the first radiating element and the second radiating element such that the first and second radiating elements are monolithically or integrally formed as one piece of material;

wherein the first and second radiating elements have rounded outer perimeters and share a common longitudinal axis where a radius of curvature of the first radiating element is the same as that of the second radiating element to monolithically form a partial cylinder shape;

wherein a side portion of the partial cylinder shape includes an open slot formed between a first side of the first radiating element and a first side of the second radiating element such that the side portion is open;

wherein a second side of the second radiating element opposite its first side is coextensive with or defined by a second side of the first radiating element opposite its first side;

whereby the first and second radiating elements are configured for use with a multi-band sleeve dipole antenna assembly that includes a ground in the form of a metallic cylindrical hollow sleeve to which the antenna element is coupled by a coaxial cable that extends through the sleeve to the antenna element; and wherein the sleeve includes a length that is a fraction of a wavelength of a lower operating frequency band of the first frequency bandwidth and the second frequency bandwidth such that the sleeve contributes to the frequency characteristics of the antenna element.

2. The antenna element of claim 1, wherein a circumferential dimension of the rounded outer perimeter of the first radiating element is less than that of the second radiating element.

3. The antenna element of claim 1, wherein the first radiating element and the second radiating element define a tubular shape having a rounded outer perimeter.

4. The antenna element of claim 1, wherein the first and second radiating element have a rolled shape defining the partial cylinder shape as a generally incomplete tube with the open slot defined between opposing side edge portions of the incomplete tube.

5. The antenna element of claim 1, wherein:

first and second spaced apart longitudinal edge portions of the body define the open slot therebetween;

the first longitudinal edge portion defines the first side of the first radiating element; and the second longitudinal edge portion defines the first side of the second radiating element.

6. The antenna element of claim 5, wherein the first radiating element and the second radiating element define a tubular shape.

7. The antenna element of claim 5, wherein the open slot extends generally along a longitudinal length of the body.

8. The antenna element of claim 1, wherein the first and second radiating elements define the open slot such that each of the first and second radiating elements includes a non-closed cross-sectional shape.

9. The antenna element of claim 1, wherein:

the first radiating element is tuned to at least one electrical resonant frequency for operating within a bandwidth between 2400 MHz and 2500 MHz; and the second radiating element is tuned to at least one electrical resonant frequency for operating within a bandwidth between 4900 MHz and 5850 MHz.

10. A dipole antenna assembly configured to be installed externally to a wireless application device, the dipole antenna assembly comprising:

a coaxial cable;

a metallic cylindrical hollow sleeve coupled to the coaxial cable, the sleeve operable as a ground for the dipole antenna assembly; and an antenna element coupled to the coaxial cable that extends through the sleeve to the antenna element, the antenna element comprising a body having a first radiating element and a second radiating element, the first and second radiating elements being integrally, monolithically defined at least partly by the body, the first radiating element being tuned for receiving electrical resonant frequencies within a first frequency bandwidth and the second radiating element being tuned for receiving electrical resonant frequencies within a second frequency bandwidth different from the first frequency bandwidth, wherein the sleeve includes a length that is a fraction of a wavelength of a lower operating frequency band of the first frequency bandwidth and the second frequency bandwidth such that the sleeve contributes to the frequency characteristics of the antenna element;

wherein the antenna element is stamped from a single sheet of conductive material forming the first radiating element and the second radiating element such that the first and second radiating elements are monolithically or integrally formed as one piece of material;

wherein the first and second radiating elements have rounded outer perimeters and share a common longitudinal axis where a radius of curvature of the first radiating element is the same as that of the second radiating element to monolithically form a partial cylinder shape;

wherein a side portion of the partial cylinder shape includes an open slot formed between a first side of the first radiating element and a first side of the second radiating element such that the side portion is open; and wherein a second side of the second radiating element opposite its first side is coextensive with or defined by a second side of the first radiating element opposite its first side;

whereby the sleeve is operable as a ground for the dipole antenna assembly such that the dipole antenna assembly is not dependent on a ground of the wireless application device.

11. The dipole antenna assembly of claim 10, wherein the antenna element includes a rounded outer perimeter.

12. The dipole antenna assembly of claim 10, further comprising a heat shrink wrap coupling the antenna element to the sleeve.

13. The dipole antenna assembly of claim 12, wherein the sleeve is tubular in shape, the dipole antenna assembly further comprising a cover configured to cover at least part of the coaxial cable, the sleeve, and the antenna element.

14. The dipole antenna assembly of claim 10, further comprising:

a base supporting the sleeve and the antenna element; and a mount for coupling the antenna assembly to an external portion of a wireless application device such that the antenna assembly is external to the wireless application device;

the base being coupled to the mount to allow pivotal movement of the base, sleeve, and antenna element relative to the mount.

15. A method of making an antenna element for a multiband sleeve dipole antenna assembly that is configured for external installation to a wireless application device, the method comprising:

forming a body of an antenna element from a sheet of conductive material such that the body includes a first radiating element and a second radiating element where the first and second radiating elements are integrally, monolithically defined at least partly by the body, wherein forming the body of the antenna element includes stamping the sheet of conductive material to form the body of the antenna element wherein the stamping process monolithically or integrally forms the first and second radiating elements as one piece of material, wherein the first radiating element is configured to be tuned for receiving electrical resonant frequencies within a first frequency bandwidth and the second radiating element is configured to be tuned for receiving electrical resonant frequencies within a second frequency bandwidth;

forming the body of the antenna element such that at least part of the body includes a tubular shape; and coupling the antenna element to a ground in the form of a metallic cylindrical hollow sleeve by a cable that extends through the sleeve to the antenna element;

wherein the sleeve includes a length that is a fraction of a wavelength of a lower operating frequency band of the first frequency bandwidth and the second frequency bandwidth such that the sleeve contributes to the frequency characteristics of the antenna element;

wherein the first and second radiating elements have rounded outer perimeters and share a common longitudinal axis where a radius of curvature of the first radiating element is the same as that of the second radiating element to monolithically form a partial cylinder shape;

wherein a side portion of the partial cylinder shape includes an open slot formed between a first side of the first radiating element and a first side of the second radiating element such that the side portion is open; and wherein a second side of the second radiating element opposite its first side is coextensive with or defined by a second side of the first radiating element opposite its first side.

16. The method of claim 15, wherein forming the body of the antenna element such that at least part of the body includes a tubular shape includes forming at least one of the first and second radiating elements to include a tubular shape.

17. The method of claim 15, wherein:

forming the body of the antenna element includes forming the open slot along a longitudinal length of the body; and forming the body of the antenna element such that at least part of the body includes a tubular shape includes forming the body such that each of the first and second radiating elements includes a non-closed cross-sectional shape.

18. The method of claim 15, wherein forming the body of the antenna element includes rolling the stamped sheet of conductive material such that the first and second radiating elements have rounded outer perimeters.

19. The antenna element of claim 1, wherein a longitudinal length dimension of the first radiating element is longer than a corresponding longitudinal length dimension of the second radiating element and the first radiating element extends beyond the second radiating element.

20. The dipole antenna assembly of claim 10, wherein the sleeve is operable as the ground for the dipole antenna assembly with the length of a quarter wavelength at the first frequency bandwidth which is lower than the second frequency bandwidth.

21. The dipole antenna assembly of claim 20, wherein:

the sleeve is tubular in shape and has a hollow interior portion;

a wrap couples the antenna element to the sleeve; and the coaxial cable includes an outer portion coupled to the sleeve and an inner conductor within an insulator that extends through the hollow interior portion of the sleeve to couple to the antenna element.

22. A dipole antenna assembly including the antenna element of claim 1, and further comprising:

a wrap coupling the antenna element to the sleeve; and the cable including an outer portion coupled to the sleeve and an inner conductor within an insulator that extends through a hollow interior portion of the sleeve and is coupled to the antenna element; and a cover configured to cover at least part of the cable, the sleeve, and the antenna element;

wherein the sleeve is operable as the ground for the dipole antenna assembly with a length of a quarter wavelength at the first frequency bandwidth which is lower than the second frequency bandwidth, whereby the dipole antenna assembly is not dependent on a ground of a wireless application device in which it is installed.

* * * * *